US005692361A

United States Patent [19]

Ziegler et al.

[11] Patent Number: 5,692,361

[45] Date of Patent: Dec. 2, 1997

[54] STACKED ARTICLE PACKAGING METHOD

[75] Inventors: Kelly W. Ziegler; Jeffrey A. Lashyro, both of Crosby, Minn.; Gary J. Vulgamore, Marietta, Ga.

[73] Assignee: Riverwood International Corporation, Atlanta, Ga.

[21] Appl. No.: 541,739

[22] Filed: Oct. 10, 1995

Related U.S. Application Data

[63] Continuation of Ser. No. 343,790, Nov. 22, 1994, abandoned, which is a continuation of Ser. No. 37,017, Mar. 25, 1993, abandoned.

[51] Int. Cl.[6] ..... B65B 5/06; B65B 35/50; B65B 61/22

[52] U.S. Cl. ..... 53/447; 53/157; 53/445; 53/540; 53/566

[58] Field of Search ..... 53/447, 445, 443, 53/475, 474, 458, 566, 251, 250, 249, 252, 540, 531, 157, 156, 48.1, 48.5

[56] References Cited

U.S. PATENT DOCUMENTS

| | | | |
|---|---|---|---|
| 2,187,382 | 1/1940 | Libbey | 229/120.32 |
| 2,756,553 | 7/1956 | Ferguson et al. | 53/159 |
| 2,796,709 | 6/1957 | Bolding | 53/35 |
| 2,999,344 | 9/1961 | Clanin et al. | 53/186 |
| 3,007,293 | 11/1961 | McGihon | 53/566.2 |
| 3,034,270 | 5/1962 | Nigrelli et al. . | |
| 3,039,248 | 6/1962 | Jones | 53/566 X |
| 3,137,981 | 6/1964 | Johnson et al. | 53/168 |
| 3,174,259 | 3/1965 | Jones et al. | 53/48 |
| 3,201,912 | 8/1965 | Woznaik | 53/540 X |
| 3,225,510 | 12/1965 | Jones et al. | 53/48 |
| 3,323,275 | 6/1967 | Kingsbury et al. | 53/207 X |
| 3,340,672 | 9/1967 | Kayser | 53/153 |
| 3,455,085 | 7/1969 | McIntyre | 53/537 X |
| 3,470,674 | 10/1969 | Madonia | 53/537 X |
| 3,473,289 | 10/1969 | Vadas | 53/537 X |
| 3,579,956 | 5/1971 | Hoffmann et al. | 53/207 X |
| 3,585,777 | 6/1971 | Pesch | 53/157 X |
| 3,604,184 | 9/1971 | Shuttleworth | 53/157 |
| 3,645,068 | 2/1972 | Langen | 53/186 |
| 3,778,959 | 12/1973 | Langen et al. | 53/26 |
| 3,826,058 | 7/1974 | Presig | 53/474 X |
| 3,834,115 | 9/1974 | Johnson et al. | 53/55 |
| 3,850,282 | 11/1974 | Calvert et al. | 198/35 |
| 3,872,643 | 3/1975 | Johnson et al. | 53/26 |
| 3,879,920 | 4/1975 | Langen | 53/63 |

(List continued on next page.)

FOREIGN PATENT DOCUMENTS

| | | |
|---|---|---|
| 902568 | 6/1972 | Canada . |
| 0242017 | 10/1987 | European Pat. Off. . |
| 0552981 | 7/1993 | European Pat. Off. . |
| 2123991 | 8/1972 | Germany . |
| 2537692 | 1/1980 | Germany . |
| 2555674 | 8/1982 | Germany . |

(List continued on next page.)

OTHER PUBLICATIONS

Pillsbury—Mead Machine Video tape, #1225, 129 (No Date).

Dimension Industries, Inc., "Continuous Motion Cartoners" a brochure (No Date).

(List continued on next page.)

*Primary Examiner*—James F. Coan

*Attorney, Agent, or Firm*—Joel D. Skinner, Jr.; Steve M. McLary

[57] ABSTRACT

A method for continuously forming stacked article groups, comprising the steps of supplying at least two streams of articles, each at a predetermined vertically distinct level; forming and longitudinally transporting a stream of first article groups having at least one article, at a first level; placing a support base on a top surface of each first article group; and forming a second article group, having at least one article, at a second level on top of the support base of each longitudinally moving first article group, whereby stacked article groups are formed. The stacked article groups are subsequently processed for packaging.

14 Claims, 17 Drawing Sheets

U.S. PATENT DOCUMENTS

| | | | |
|---|---|---|---|
| 3,881,298 | 5/1975 | Griner et al. | 53/496 X |
| 3,906,705 | 9/1975 | Beck et al. | 53/252 |
| 3,923,144 | 12/1975 | Langen | 198/31 AB |
| 3,941,236 | 3/1976 | Hagendorn | 198/29 |
| 3,956,868 | 5/1976 | Ganz et al. | 53/48 |
| 3,990,572 | 11/1976 | Fishback | 198/458 |
| 4,043,097 | 8/1977 | Ishida et al. | 53/157 X |
| 4,098,050 | 7/1978 | Dietz et al. | 53/26 |
| 4,211,054 | 7/1980 | Stramek | 53/502 |
| 4,221,107 | 9/1980 | Langen | 53/575 |
| 4,237,673 | 12/1980 | Calvert et al. | 53/48 |
| 4,250,693 | 2/1981 | Andersson | 53/543 |
| 4,421,229 | 12/1983 | Pan et al. | 229/4 |
| 4,571,236 | 2/1986 | Adams | 493/319 |
| 4,633,655 | 1/1987 | Nigrelli, Sr. | 53/543 |
| 4,642,967 | 2/1987 | Culpepper | 53/398 |
| 4,685,275 | 8/1987 | Nigrelli, Sr. | 53/458 |
| 4,693,055 | 9/1987 | Olsen, Jr. et al. | 43/443 |
| 4,756,139 | 7/1988 | Le Bras | 53/398 |
| 4,802,324 | 2/1989 | Everson | 53/398 |
| 4,815,251 | 3/1989 | Goodman | 53/156 X |
| 4,887,414 | 12/1989 | Arena | 53/543 |
| 4,936,077 | 6/1990 | Langen et al. | 53/543 |
| 4,982,551 | 1/1991 | Nigrelli, Sr. | 53/55 |
| 5,027,586 | 7/1991 | Ramaker | 53/458 |
| 5,036,644 | 8/1991 | Lashyro et al. | 53/398 |
| 5,052,544 | 10/1991 | Anderson | 198/456 |
| 5,072,573 | 12/1991 | Tisma | 53/252 |
| 5,079,896 | 1/1992 | Langen et al. | 53/252 X |
| 5,185,984 | 2/1993 | Tisma | 53/252 |
| 5,237,795 | 8/1993 | Cheney et al. | 53/154 |
| 5,241,806 | 9/1993 | Ziegler et al. | 53/566 |
| 5,246,113 | 9/1993 | Schuster | 206/430 |
| 7,856,450 | 9/1993 | Ziegler et al. | 53/252 |

FOREIGN PATENT DOCUMENTS

| | | |
|---|---|---|
| 3301013 | 7/1984 | Germany . |
| 3537690 | 4/1987 | Germany . |
| 4952969 | of 0000 | Japan . |
| 4683414 | 5/1972 | Japan . |
| 5579203 | 6/1980 | Japan . |
| 56-131102 | 10/1981 | Japan . |
| 58-90020 | 5/1983 | Japan . |
| 60-21403 | 2/1985 | Japan . |
| 61-178803 | 8/1986 | Japan . |
| 62-158604 | 7/1987 | Japan . |
| 63-178922 | 7/1988 | Japan . |
| 1124504 | 5/1989 | Japan . |
| 2127224 | 5/1990 | Japan . |
| 3501013 | 3/1991 | Japan . |
| 3158318 | 7/1991 | Japan . |
| 431202 | 2/1992 | Japan . |
| 4114804 | 4/1992 | Japan . |
| 4239424 | 8/1992 | Japan . |
| 4242520 | 8/1992 | Japan . |
| 9002686 | 3/1990 | WIPO . |

OTHER PUBLICATIONS

Minnesota Automation, "Continuous Motion Cartoner Guidelines", Sep., 1991.

Thiele Engineering Company, Five Photographs, pp. 4–162—4–166 (No Date).

Manville Forest Products Corporation, "Packaging Systems, MEL2", a brochure (No Date).

Manville Forest Products Corporation, "The Leader of the Pack, Multiple Packaging Systems", a brochure (No Date).

R.A. Jones & Co., Inc., "Jones Model OSC", a brochure Mar., 1983.

Langenpac Machinery Manufacturer, Langenpac NV, "Canpacker 2000", a brochure (No Date).

ADCO Manufacturing, Inc., "JBC Barrel Can Cartoning Machine", a brochure (No Date).

Kliklok International, Ltd., "Kliklok Concorde Enload Machine", a brochure, Jun. 23, 1988.

APV Douglas Machine Corp., Alexandria, Minnesota, Video Tape, "M–2207 Continuous Motion WrapAround Case Packer" (Submitted by Applicants).

APV Douglas Machine Corp., Alexandria, Minnesota, "Mid–America Diaryman CMWACP Floor Plan", Aug. 23, 1989, Drawing No. FP–4690C (Submitted by Applicants).

STACKED ARTICLE PACKAGING METHOD

This application is a continuation, of application Ser. No. 08/343,790, filed Nov. 22, 1994, now abandoned, which is a continuation of Ser. No. 08/037,017 filed on Mar. 25, 1993 now abandoned.

BACKGROUND OF THE INVENTION

This invention relates to packaging methods and apparatus. Particularly, this invention relates to a continuous method of forming stacked or multiple layer article groups. The packaging method of the present invention is useable to package different types, styles and sizes of articles, in a wide range of stacked article group patterns, and into a variety of packaging media, into cartons in a fast and reliable manner.

In the past, various machines and processes have been proposed and utilized to package selected article groups into packages. Each prior art machine and process, however, accomplishes the packaging of the article groups in a distinct manner and utilizes particular machinery. Moreover, prior art cartoners have limited adjustability, limited output capability, and have been difficult to construct and maintain due to their respective designs. And finally, no method or apparatus, insofar as is known provides continuous motion packaging of stacked or layered product groups.

Prior art packaging assemblies include U.S. Pat. No. 4,802,324 to applicants' assignee for a Vertical Cartoning Assembly and Method which discloses the placement and assembly of cartons over preselected article groups being moved on a conveyor. U.S. Pat. No. 5,036,644, also to applicant' assignee, discloses a Packaging Sleever Assembly which transfers flat packaging sleeves directly onto preselected article groups and subsequently wraps and closes the cartons. Various end loading packaging machines have also been proposed in the art. For example, U.S. Pat. No. 3,778,959 to Langen et al. discloses an end loader which utilizes a plurality of transversely extending spaced apart fences or flights mounted on a conveyor to rake or capture a predetermined number of containers from infeed container slips. U.S. Pat. No. 4,237,673 to Calvert et al. discloses a machine also for loading container sleeves through their open ends. U.S. Pat. No. 4,936,077 to Langen et al. discloses a carton loading machine which utilizes pusher mechanisms with spring loaded pusher heads to stagger adjacent product group rows during transfer into the carton.

In view of the limitations and shortcomings of prior art methods and apparatus, it is an object of this invention to provide a method of continuously and reliably forming stacked product groups at high speed. Another object of this invention is to provide a packaging method which is useable with a variety of package types, articles and stacked article group types and sizes. A particular object of the invention is to provide a method which forms stacked or multiple layer article groups via a base member disposed between a lower article sub-group and an upper article sub-group.

SUMMARY OF THE INVENTION

The present invention provides a method for continuously forming stacked article groups, comprising the steps of: supplying at least two streams of articles, each at a predetermined vertically distinct level; forming and longitudinally transporting a stream of first article groups having at least one article, at a first level; placing a support base on a top surface of each the first article group; forming a second article group, having at least one article, at a second level at or above the support base of each longitudinally moving first article group, whereby stacked article groups are formed. The support base is preferably constructed of paperboard and has a thin, substantially flat, rectilinear configuration with a surface area substantially coextensive with that of the top surface of the first article group. The support base may have a flap member disposed along one base edge and defined by a scoreline, the flap member being foldable over one edge of the top surface of the first article group.

In a preferred embodiment, the invention provides a continuous cartoning method for loading stacked article groups into packages or cartons of a type having an outer structure and an inner divider structure, comprising the steps of: supplying at least one stream of articles at a first predetermined location and a first vertical level along a longitudinally oriented axis; forming and longitudinally transporting a stream of lower article sub-groups at the first location; depositing the inner divider structure at a second predetermined location along the axis, downstream from the first location; supplying at least one stream of articles at a third location downstream from the second location, and at a second vertical level higher than the first vertical level; slidably forming, at the third location, an upper article group on each the divider structure of each the lower article sub-group, whereby stacked article groups are formed; transporting the stacked article groups along the longitudinal axis; providing a longitudinal stream of cartons, with open ends facing and synchronized with the stacked article groups, adjacent to and parallel with the article groups; and laterally moving the stacked article groups into the synchronized cartons.

These and other benefits of this invention will become clear from the following description by reference to the drawings.

DESCRIPTION OF THE PREFERRED EMBODIMENT

Figure 1:
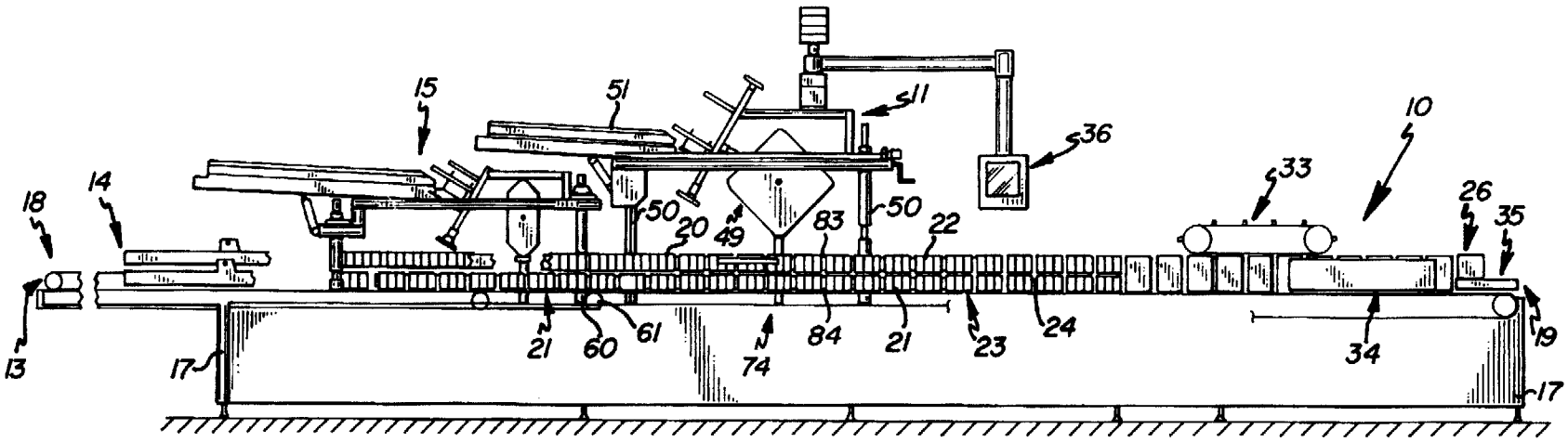
FIG. 1 is a side view of the packaging or cartoning assembly of the present invention.

The methods and apparatus of the present invention are for forming stacked article groups in a continuous, high speed process. As shown in the drawings, the method of this invention is implemented via a continuous motion, high-speed packaging apparatus 10. The apparatus 10 is adjustable to provide reliable, continuous and high speed packaging of articles or products of varying types, sizes and quantities into packages of varying types and sizes. For example, the apparatus 10 is useable to load standard twelve ounce beverage cans into 24(12/12), 30(15/15) and 36(18/18) pack stacked combinations. Moreover, the process of loading beverage containers into paperboard cartons, for example, is accomplished quickly and reliably, under typical industry tolerances for both container and carton construction. The resultant filled cartons output by the apparatus 10 are of high quality and consistency, having maximized squareness and tautness for improved storage qualities and transportability. Although the embodiments disclosed load stacked article groups into paperboard cartons, its within the purview of this invention to process the stacked article groups in a variety of ways subsequent their formation, including side loading, shrink wrapping, banding or having paperboard or other material formed around them.

Figure 2:
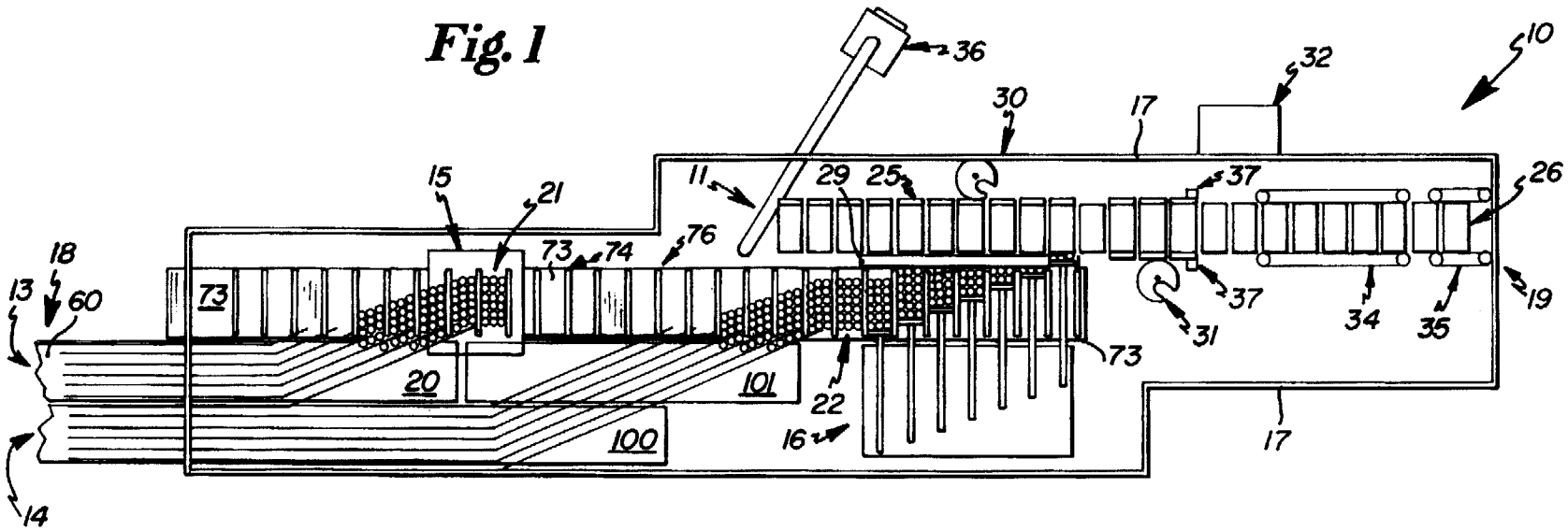
FIG. 2 is a top plan view of the cartoner assembly.
Figure 11:
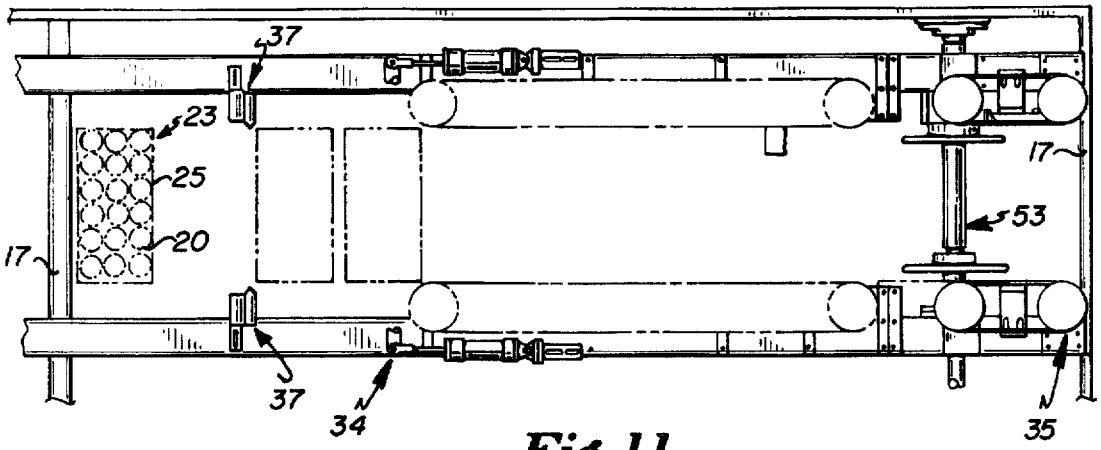
FIG. 11 is a top view of the discharge end of the carton supply and transport mechanism.

Referring to FIGS. 1 and 2, the continuous motion cartoner assembly 10 generally comprises a carton supply and transport mechanism or stream 11, an article group selection and transport mechanism or stream 12, a pair of article supply mechanisms or streams 13 and 14, a divider placement mechanism 15, and an article group transfer or cross loading mechanism 16. These mechanisms are shown to be supported by a unitary frame structure 17, although if aligned properly, separate support structures may be utilized consistent with the teachings of this invention.

The carton supply mechanism 11 is shown to be disposed proximate an input end 18 of the assembly 10. Carton sleeves or blanks 25 are subsequently transported in a linear fashion to an output end 21 of the apparatus 10. The article supply mechanisms 13 and 14 are also shown to be disposed at the input end 20 of the apparatus 10. A first portion of each article supply mechanism 13 and 14 is disposed spacially parallel to the article group selection and transport mechanism 12, and a second portion merges, at a predetermined angle, with the article group selection transport mechanism 12 to supply streams of product or articles 20 to two separate positions along the article group selection and transport mechanism 12. These merging mechanisms 12–14 are further constructed and arranged to meter individual articles 20, via a fixed flight bar arrangement, into predetermined stacked article groups 21 and 22 on the mechanism 12.

The stacking function of the device 10 is accomplished by forming a first group 21 at a low level, placing a separator or divider sheet 24 on the lower group 21 via the divider sheet placement mechanism 15, and then simultaneously forming a second group 22 downstream at a higher level and allowing the upper group 22 to slide across the divider sheet 24 by the action of the flight bars of the article group selecting mechanism 12. In an alternative embodiment, the second group is formed on an upper dead plate and dropped or otherwise deposited onto the divider sheet.

The article group selection and transport mechanism 12 is disposed adjacent and parallel to the carton supply and transport mechanism 11 and extends downstream, in a linear orientation. Merged or combined article groups 23 are transported downstream thereon in a spaced and metered fashion, each group 23 being aligned with a carton 25 traveling on the carton supply and transport mechanism 11. The crossloading mechanism 16 is disposed adjacent to and parallel with the second portion of the article group selection and transport mechanism 12, extending and traveling longitudinally with respect to the apparatus 10. The crossloading mechanism 16 has a plurality of loading arms which extend transversely or perpendicularly with respect to the transport mechanisms 11, 13 and 14, to move product groups 23 on the article group selection transport mechanism 12 into aligned cartons 25 traveling on the carton transport mechanism 11, thereby loading the cartons 25 with product groups 23. Preferably, each of the aforementioned mechanisms 11–14 and 16 has a conveyor type structure with an endless chain or belt configured about rotatable drive and idler end means and moving longitudinally with respect to the input (upstream) and output (downstream) ends 18 and 19 of the apparatus 10. The movement of each mechanism is further synchronized with one another, for example by a common drive and/or gearing means.

Figure 3:
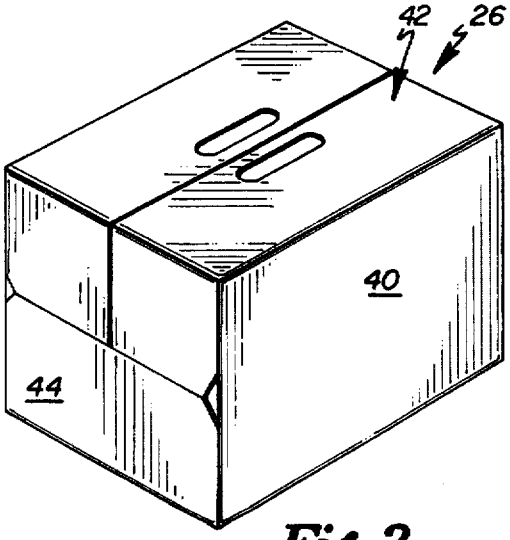
FIG. 3 is a perspective view of a carton assembled by the cartoner assembly.
Figure 4:
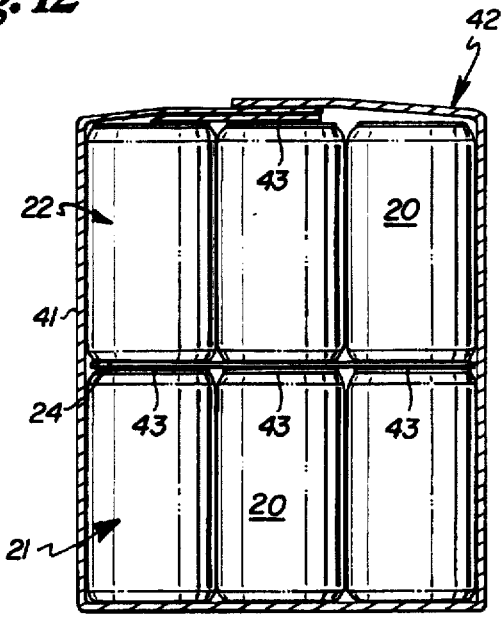
FIG. 4 is a crossectional view of the carton taken along line 4—4 of FIG. 3.

Referring to FIGS. 3 and 4, the method of this invention is useable to construct carriers or cartons 26 containing cans 20 or other articles which are disposed on top of one another or stacked. The paperboard carrier blank or sleeve 26 is comprised of leading and trailing side panels 40 and 41 foldably connected to top panel 42 and to a bottom panel 43. End panels 44 connect the top, bottom and side panels 40–43. As shown, the carrier 26 contains a bottom layer or sub-group 21 of articles, shown for purpose of illustration as beverage cans 20, and an upper layer or sub-group 22 of cans in stacked relationship. The lower ends of the upper cans 22 are supported on a thin, paperboard divider sheet 24 (also referred to as a base or support sheet) with the bottom cans 21 resting on the bottom panel 43. An extension tab located on the medial edge of the sheet 24, and which folds down via a perforation or scoreline is preferably provided to help stabilize the divider sheet 24. The extension tab provides a means for holding the sheet 24 stable while the upper layer of cans 22 are pushed onto the separator sheet 24. Once the cans 23 have been all properly positioned the sheet 24 is held in place by guides on the apparatus 10. The top panel 42 is disposed closely adjacent, and preferably is in contact with, the top chimes 43 of the upper level 22 of cans to provide for a tight fit between the cans 20 and the carrier 25. Although the apparatus 10 shown in the drawings is utilized in a beverage can cartoning operation with paperboard carrier sleeves, modifications consistent with the teachings of this invention may be made to package various other stacked containers or articles. In various carrier configurations or to package the article groups via shrink wrapping, banding or the like.

Referring also to FIGS. 5, 6, 20 and 22, the carton supply and transport mechanism 11 is preferably a rotary type carton placer 49, such as that disclosed in U.S. Pat. No. 4,530,686 owned by Applicant' assignee. The carton erecting apparatus 49 is supported above the input end of the carton transport mechanism 11 by a vertically adjustable frame structure 50, and basically transfers flat carton blanks or sleeves 25 from a power magazine 51 to the conveyance surface of the mechanism 11, simultaneously opening the blank 25 so that it assumes a four-sided configuration with opposing open ends bounded by at least one flap 44 each. Importantly, the partially erected carton 25 is placed in a transverse or lateral orientation so that its ends are open to the sides of the carton transport mechanism 11 for loading purposes.

The carton transport conveyor 52 receives cartons or other carriers 25 from the carton supply placer 49 and transports them linearly downstream with respect to the overall apparatus 10. The downstream transport of cartons 25 is synchronized with the article group selection and transport mechanism 12 and with the crossloading mechanism 16, as described further below, to effectuate carton 25 loading. Importantly, the carton transport conveyor 52 is adjustable to accommodate cartons 25 of varying types and sizes. Referring also to FIGS. 9, 10 and 22–25 in particular, the carton transport conveyor 52 basically comprises a plurality of flight lugs 56 which are connected to a pair of flight chains 181 and 182, the flight chains 181 and 182 being connected to and revolving about drive and idler ends 53 and 54. Although a pair of lugs 56 is shown, the number of lugs 56 per carton 25 may be varied for alternative carton configurations. The lugs 56 are shown to serve a dual purpose in that they are disposed anterior with respect to a particular carton 25 for control and stabilization purposes, while the pair 56 which is disposed posterior to the carton urges the carton 25 forward on the conveyor mechanism 52. The lugs 56 are preferably constructed of nylon or a similar material. The lugs 56 are attached to the flight chains 181 and 182 via lug bases. The flight chains 181 and 182 are supported at the top or forward run of the conveyor 52 by chain guides 183. The chain guides 183 are connected to the main frame 17 via guide supports 184. An elongated, longitudinally extending return guide 185 is disposed along the bottom run of the conveyor 52 and mates with a notch in each lug 56 to stabilize their return during high speed operation. Additionally, a longitudinally oriented slide rail (not shown) may be disposed between the flight chains 181 and 182, level with the horizontal plane of the chain guides 183, and with a low-friction top surface to support the bottom of each carton 25 on the conveyor 52. The width-wise or transverse spacing between lugs 56 on the parallel, side-by-side chains is preferably variable via a transverse lug adjustment mechanism. Although a single pair of flight lugs 56 is shown, an alternative structure may be constructed with phase adjustable leading and trailing flight lugs, as is known in the art. This phase adjustment is desirable to permit the apparatus 10 to be used with various carton configurations to allow for adjustment of carton spacing between, for example, 6 and 12 inch, on center arrangements to convert the apparatus 10 from 6 to 36 pack processing.

Referring to FIGS. 5, 10 and 14–17, the apparatus preferably includes a carton stabilization structure 28 which supports the tops of the relatively tall, bi-level cartons 25 traveling on the carton supply and transport mechanism 11, particularly during the loading phase of operation. The carton stabilization structure 28 basically comprises a pair of overhead rails 191 and 192 connected to vertical and horizontal support members 193 and 194 which are linked via adjustment mechanism 195 supported by posts 196. A carton sleeve set up guide assembly 197 is also preferably disposed anterior to the carton stabilizer 28 and immediately downstream of the point of initial placement of the sleeve on the conveyor 52 by placer 49.

Figure 5:
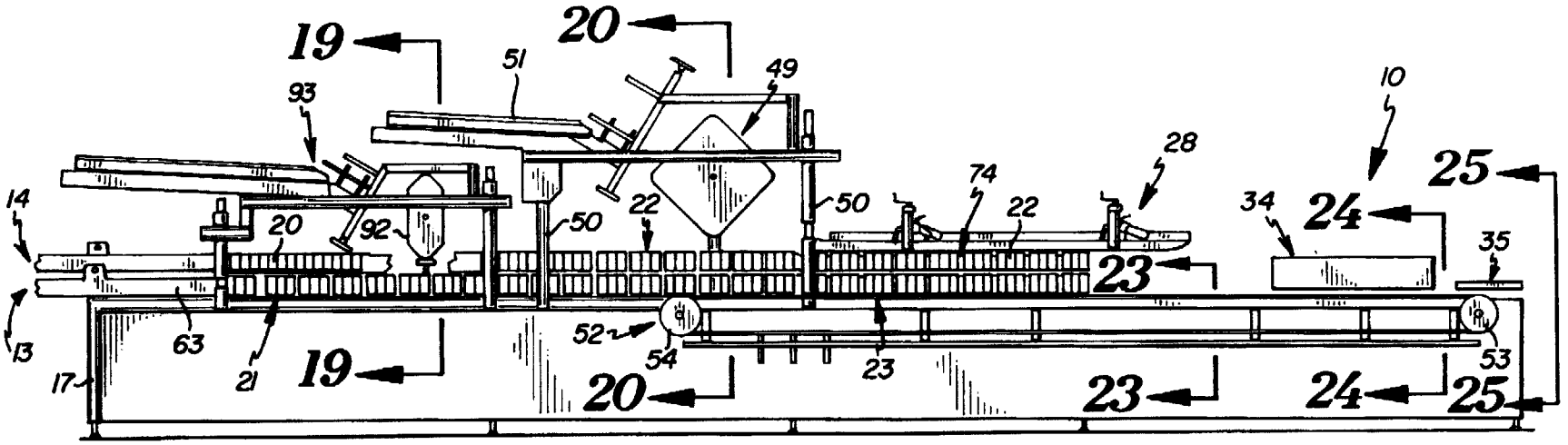
FIG. 5 is a detailed side view of the cartoner assembly.
Figure 6:
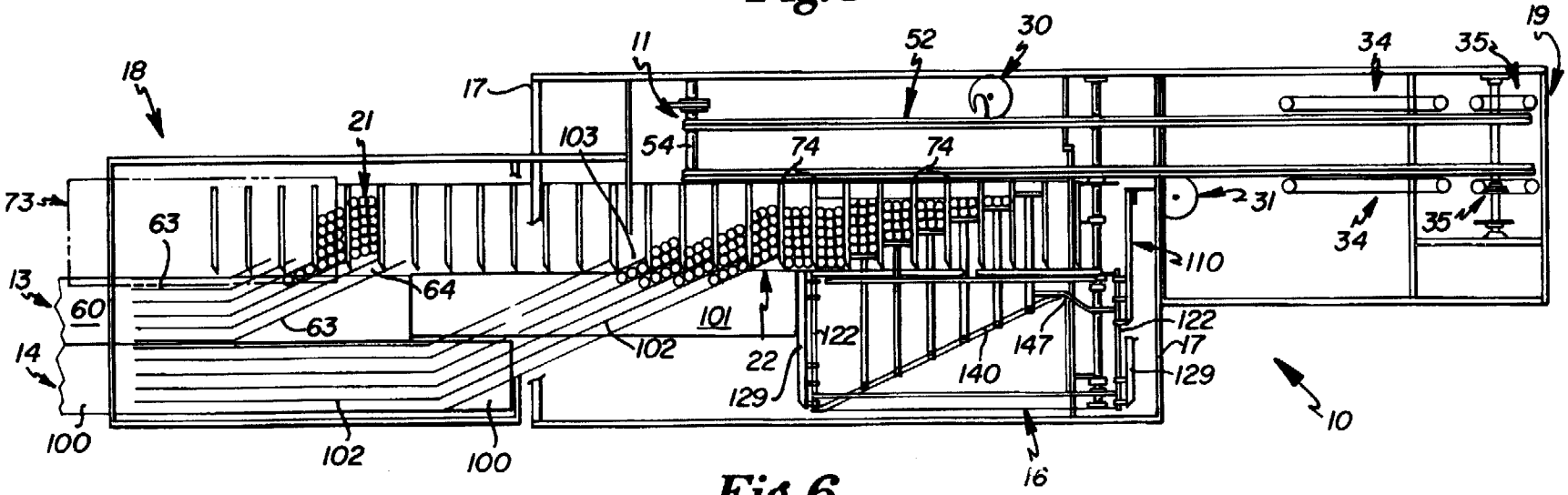
FIG. 6 is a detailed top plan view of the cartoner assembly.
Figure 13:
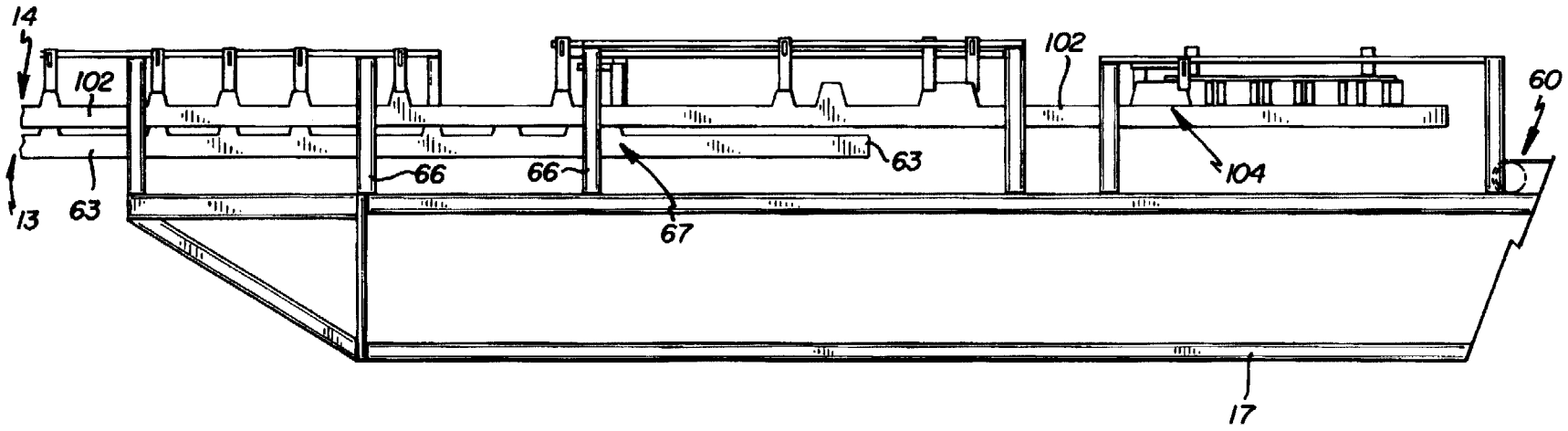
FIG. 13 is a side view of the infeed guides of the article supply mechanisms.
Figure 14:
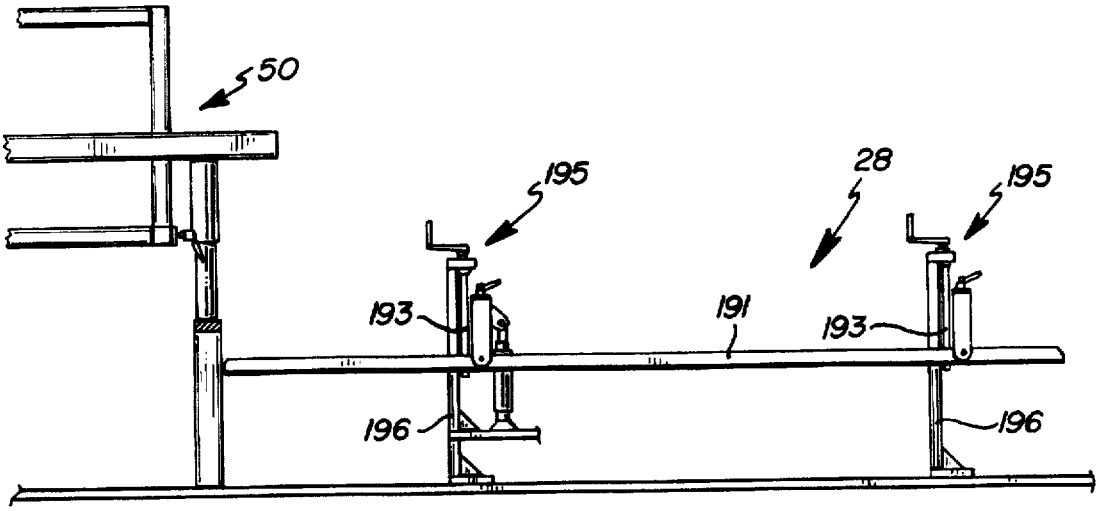
FIG. 14 is a side view of the carton support assembly of the carton supply and transport mechanism.
Figure 15:
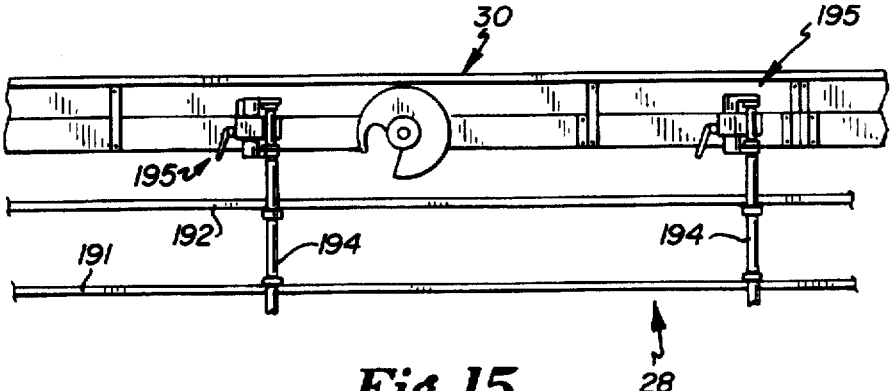
FIG. 15 is a top view of the carton support assembly of FIG. 14.
Figure 16:
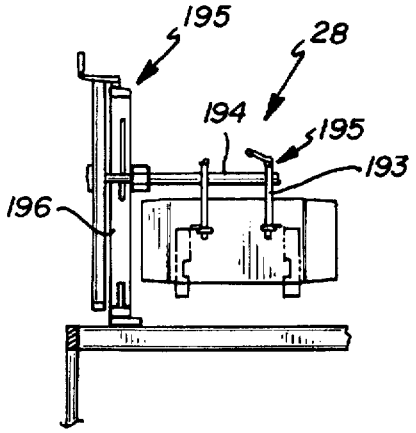
FIG. 16 is a left end view of the carton support assembly of FIG. 14.
Figure 17:
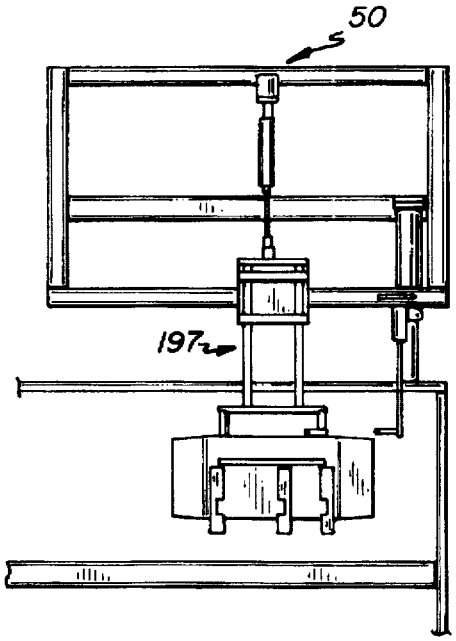
FIG. 17 is a right end view of the carton support assembly of FIG. 14.
Figure 23:
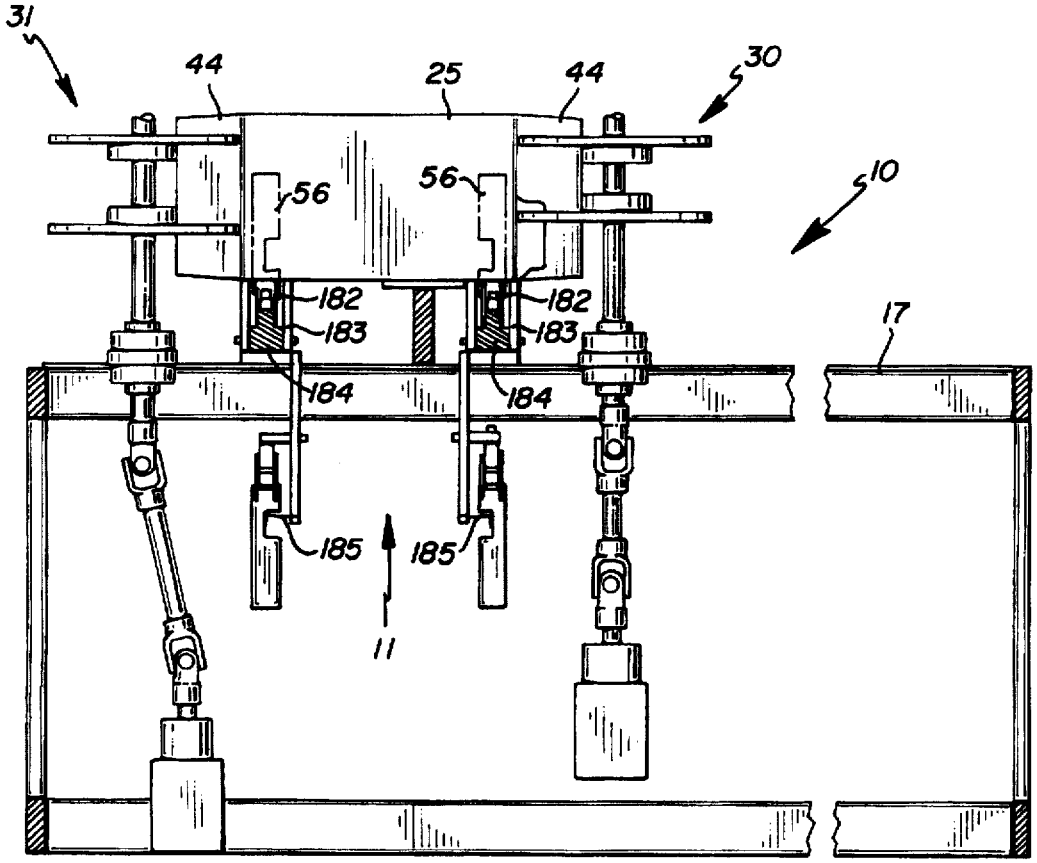
FIG. 23 is a crossectional view of the cartoner apparatus taken approximately along line 23—23 of FIG. 5.
Figure 18:
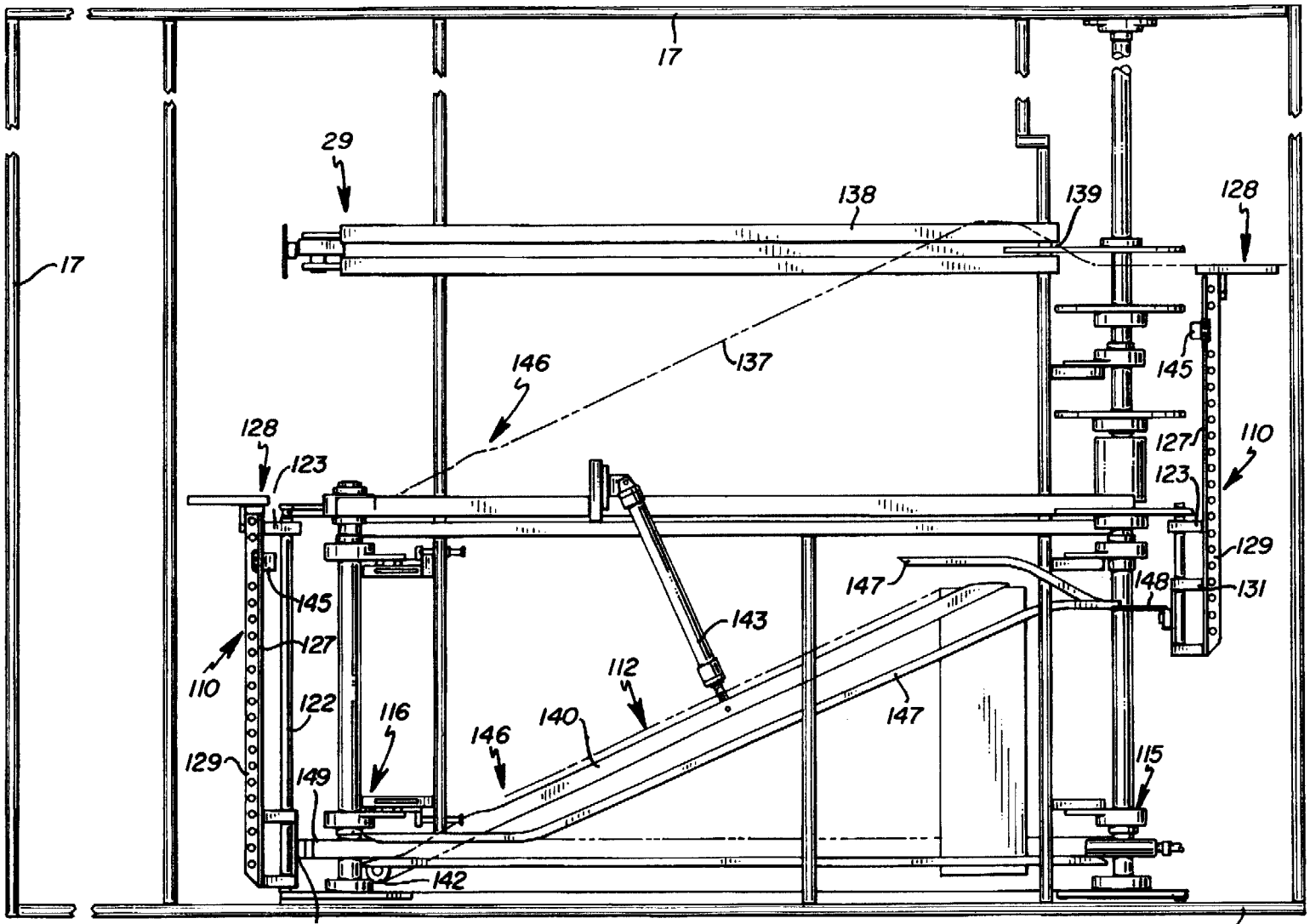
FIG. 18 is a top view of the crossloading mechanism.

Referring to FIGS. 5, 6 and 13, the first or low article supply mechanism 13 provides a plurality of input individual articles 20 to the apparatus 10 at a first predetermined level or height and at a predetermined point on the article group selection and transport mechanism 12. The mechanism 13 is shown to comprise a conveyor 60 disposed about a drive sprocket/shaft assembly 61 and an idler sprocket/shaft assembly 62. The conveyor 60 preferably consists of a unitary, belt. Articles 20 transported on the top, forward run of the conveyor 60 are separated into a plurality of single file paths by lane separators 63. Each lane separator 63 is shown to be an upstanding plate of a height sufficient to guide the flow of one or more containers 20 on the conveyor 60, and which is suspended above the conveyor 60. The lane separators 63 form product conveyance lanes which angle towards the article group selection and conveyance mechanism 12. An approach angle of approximately 20–25 degrees with respect to the longitudinal axis of the mechanism 12 has been found to provide optimal product group selection results. The conveyor 60 is disposed parallel with and immediately proximate to the article group selection and transport conveyor 12 to allow for article movement thereinbetween. A low friction, dead plate having angled lane grooves which correspond with the lane separators 63 preferably interposed at the interface between the conveyor 60 and the transport mechanism 12. Each lane separator 63 has a terminal portion 64 of a predetermined length, such that it extends into the path of the article group selection and transport mechanism 12 a distance approximately equal to one-third the width of the mechanism 12 conveyance path. Each terminal portion 64 is constructed such that it allows longitudinally transported flight structures 74 (described further below) of the article group selection and transport mechanism 12 to pass through the angled conveyance lanes. As the flight bars 74 mesh with and pass through the lane separator end portions 64, they engage articles 20 disposed in lanes and rake them onto the longitudinal conveyance path of the mechanism 12 and between adjacent flight bars 74.

The combination of forces exerted by the flight bars 74, lane ends 64, and conveyors 60 and 12 serve to select and meter individual articles 20 into predetermined article groups 21 which are fully merged onto the article group selection and transport mechanism 12. The size, orientation and dimensions of the resultant product groups 21 is dependent upon the number of infeed lanes, product dimensions, and the configuration and spacing of the flight bars 74. For example, in the instant embodiment, six (6) lanes of product are active, and the flight bars 74 are spaced such that the resultant product group 21 is selected of eighteen (18) articles in three rows of six cans each. Lanes may be blocked off by closure means 67 to alter the group 21 size and/or orientation. The lane separators 63 and the flight bars 74 are adjustable to provide full variability of product group parameters.

The low article supply mechanism 13 is shown to terminate at its infeed end 18 for mating with a complementary external apparatus, for example an additional infeed conveyor or conveyors. Alternatively, such infeed conveyor may be integrated with the apparatus 10. Further, although this embodiment utilizes conveyance lanes which are initially oriented parallel with the remaining elements of the apparatus 10 and subsequently angle towards the article group selection transport mechanism 12, it is possible to provide an infeed conveyor that is entirely angled as such.

Figure 7:
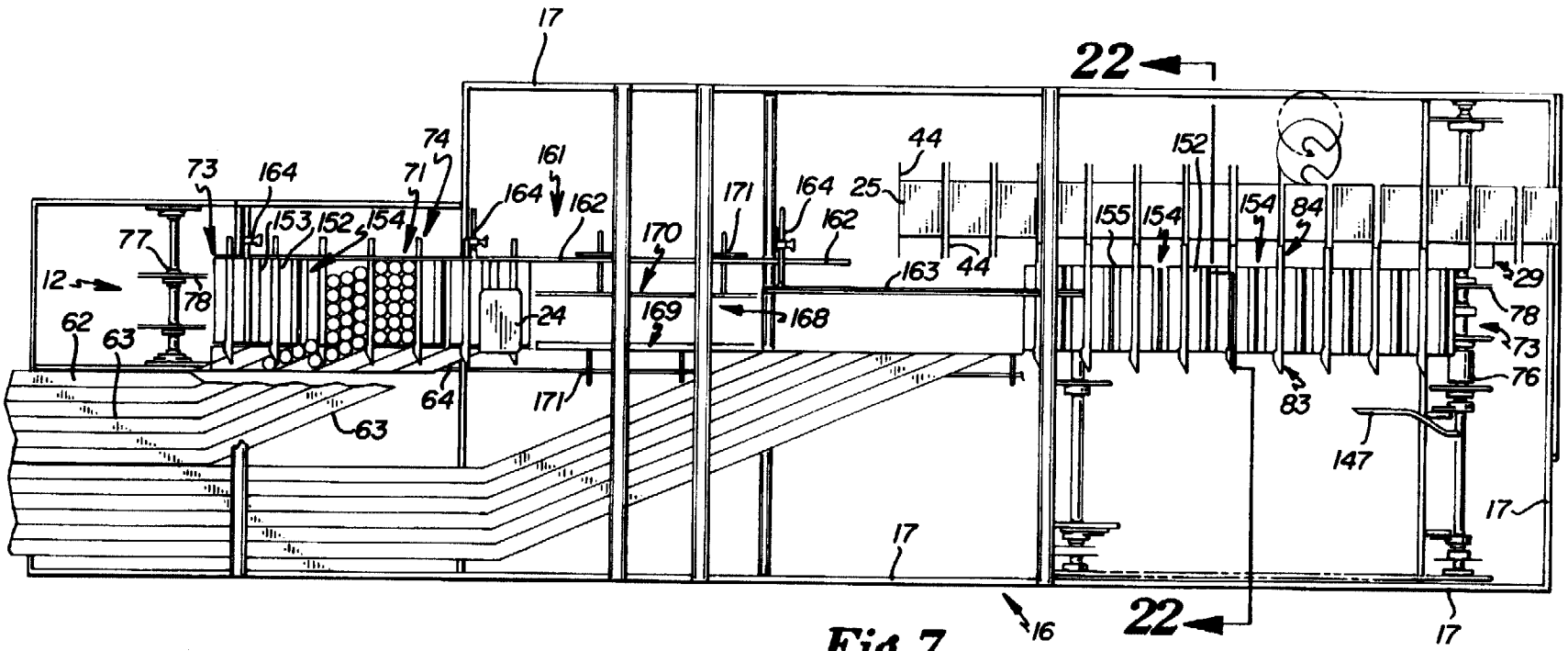
FIG. 7 is a top plan view of a portion of the cartoner assembly.
Figure 21:
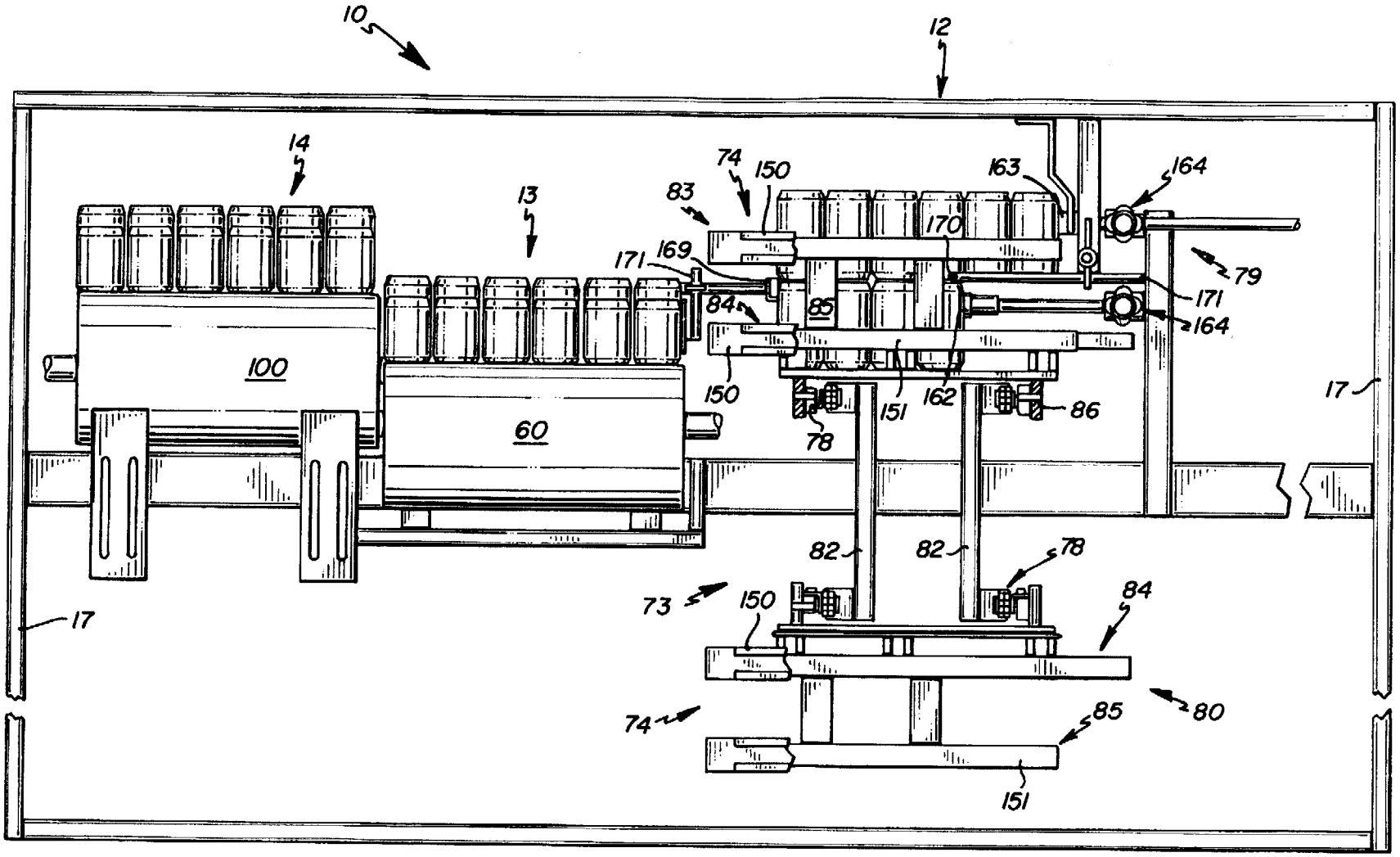
FIG. 21 is a crossectional view of the cartoner apparatus showing details of the article group selection and transport mechanism.
Figure 22:
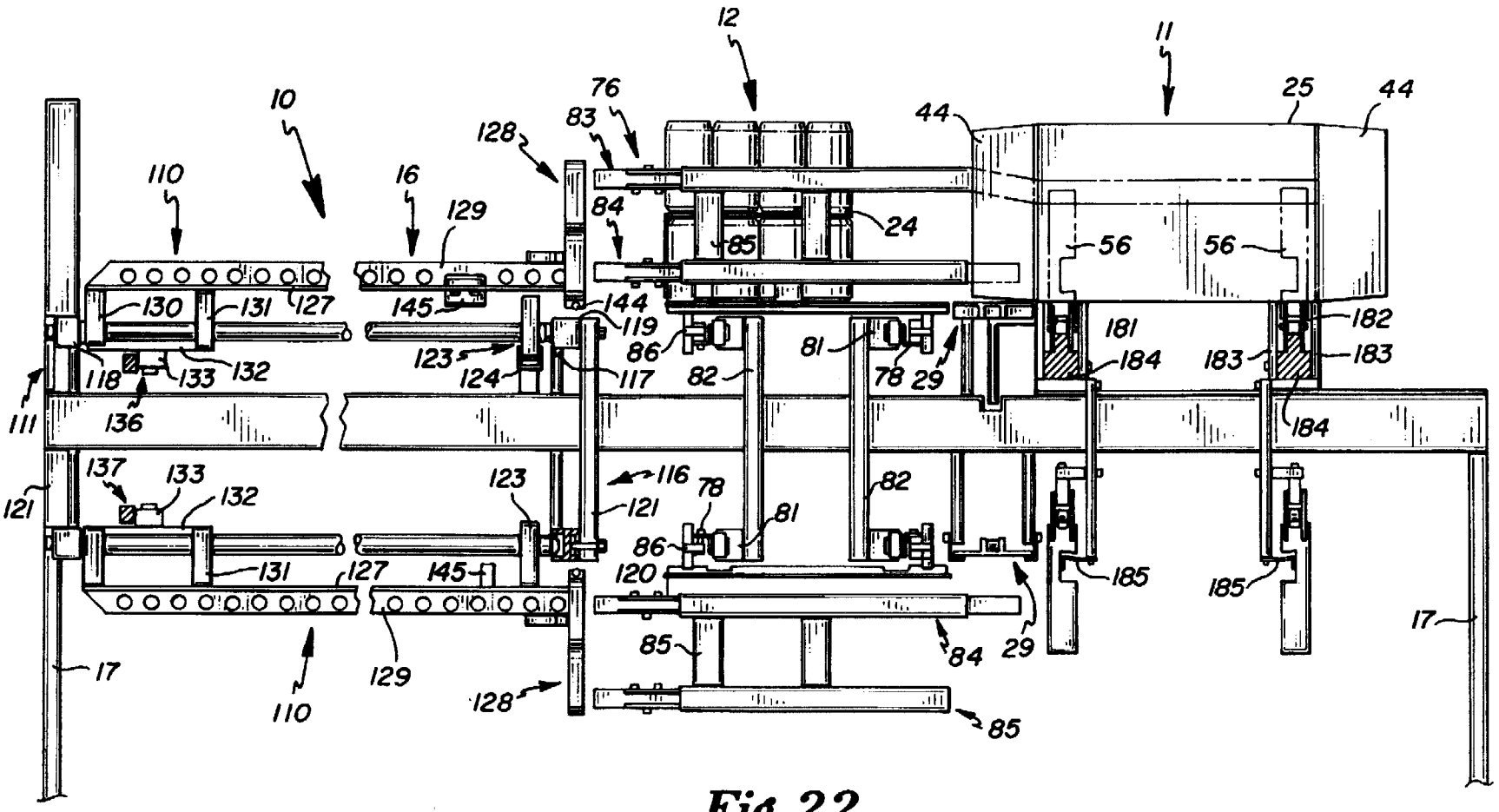
FIG. 22 is a crossectional view of the cartoner apparatus taken along line 22—22 of FIG. 7.
Figure 24:
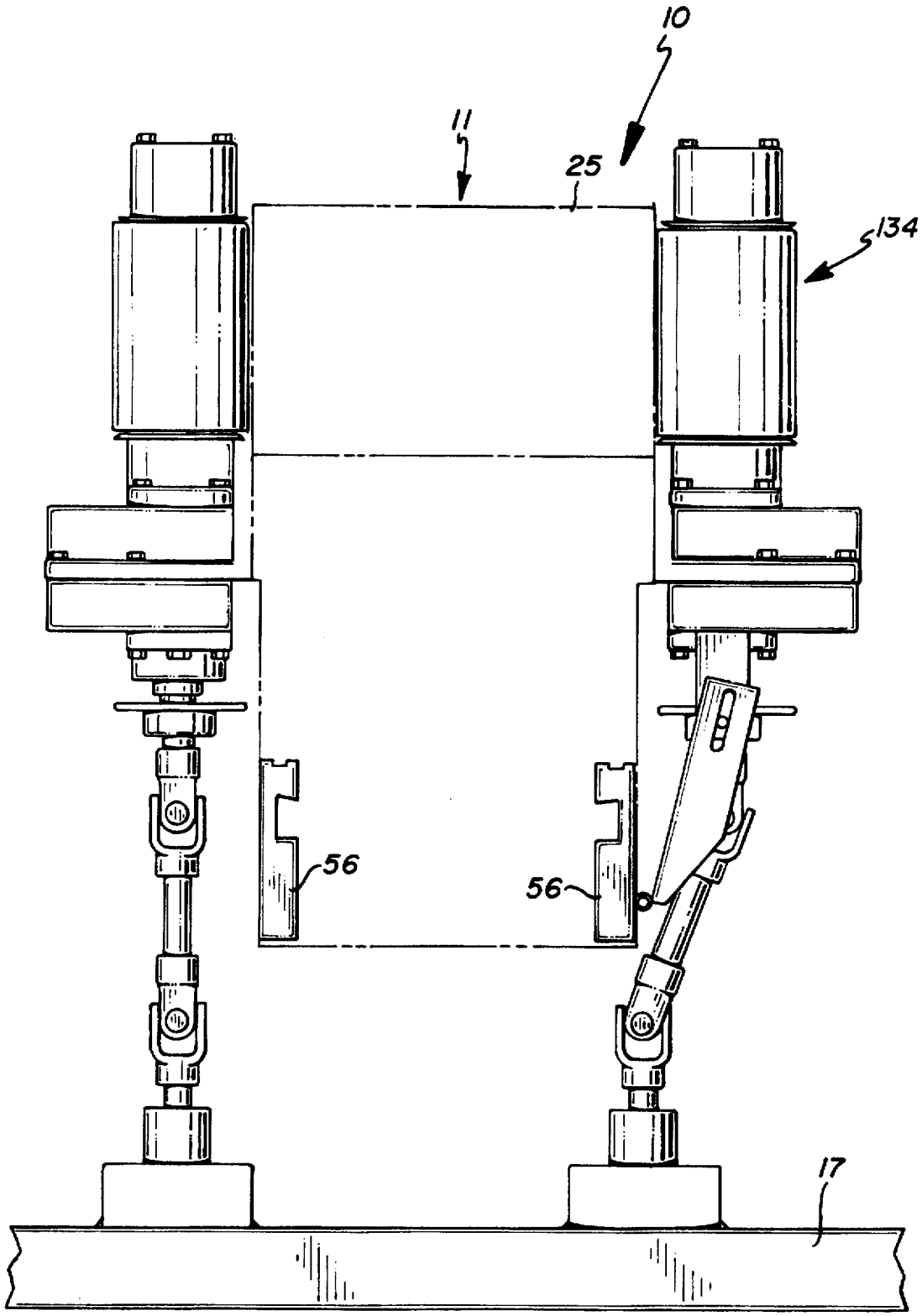
FIG. 24 is a crossectional view of the cartoner apparatus taken approximately along line 24—24 of FIG. 5.
Figure 25:
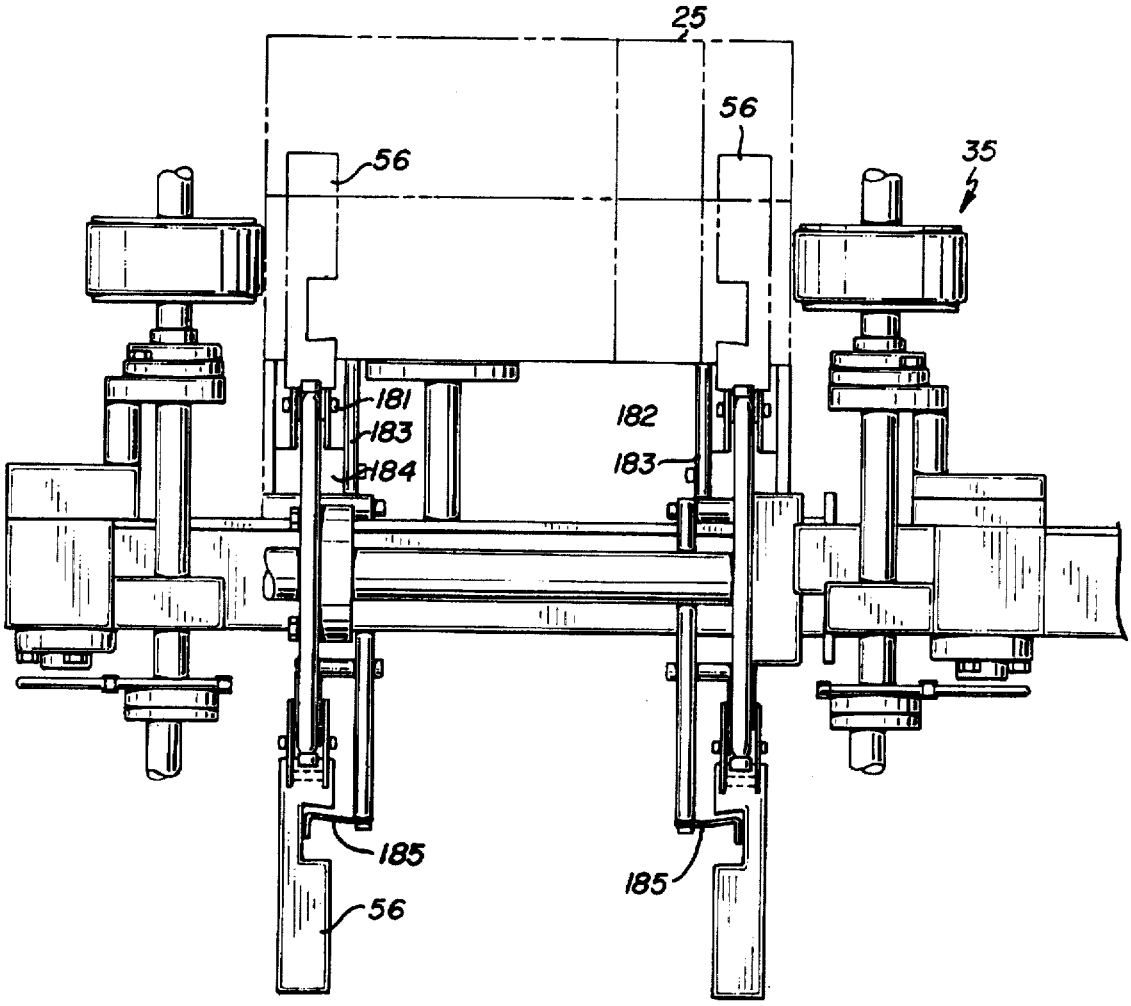
FIG. 25 is a crossectional view of the cartoner apparatus taken approximately along line 25—25 of FIG. 5.
Figure 26:
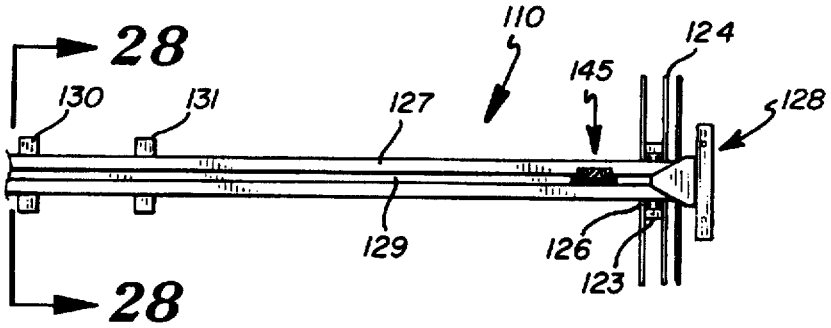
FIG. 26 is a top view of a loader arm assembly.
Figure 27A:
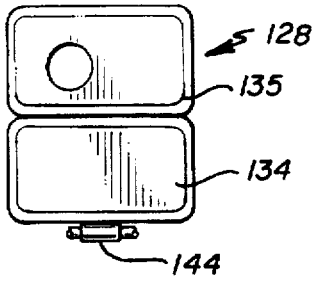
FIGS. 27*a* and 27*b* are side and end views of a pushing face.
Figure 27B:
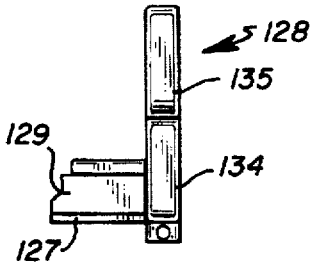
Figure 30:
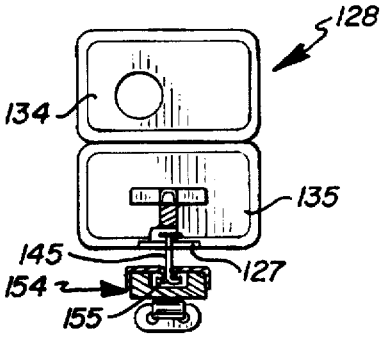
FIG. 30 is a crossectional view of a loader arm assembly operatively extended across the article group selection and transport mechanism.
Figure 28:
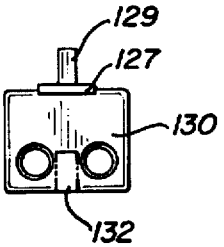
FIG. 28 is an end view of the loader arm assembly taken along line 28—28 of FIG. 26.

The article group selection and transport mechanism 12 selects article groups 21 and 22 from the first or low article supply mechanism 13 as set forth above and from the second or high article supply mechanism 19 discussed below, and transports them linearly downstream with respect to the overall apparatus 10. The downstream transport of article groups 21 and 22 is synchronized with the carton supply and transport mechanism 11 and with the crossloading mechanism 16, as described further below, to effectuate carton 25 loading. Referring also to FIGS. 7, 21 and 22, the article group selection and transport mechanism 12 generally comprises a conveyor 73, a plurality of flight bar assemblies 74 fixed to and longitudinally transported on the conveyor 73, and a plurality of slide plates 75, which are disposed on the conveyor 73 between the spaced flight bars 74.

The conveyor 73 runs at a predetermined speed and includes a drive sprocket/shaft assembly 76 and an idler sprocket/shaft assembly 77, a pair of parallel endless conveyor chains 78 which are connected to and revolve about the sprocket/shaft assemblies 76 and 77, forming a longitudinally extending forward or top run 79 and a return or bottom run 80. Idler assembly 77 is disposed just anterior to the area where the first or low article supply mechanism 13 merges with the article group selection and transport mechanism 12, and marks the beginning of the conveyor 73. The drive sprocket/shaft assembly 76 is disposed adjacent the end of the crossloading mechanism 16 and marks the end of the conveyor 73. The conveyor chains 78 are each supported by top and bottom longitudinally extending chain guides 81, which in turn are connected to the main frame 17 via upstanding conveyor supports 82.

Figure 31:
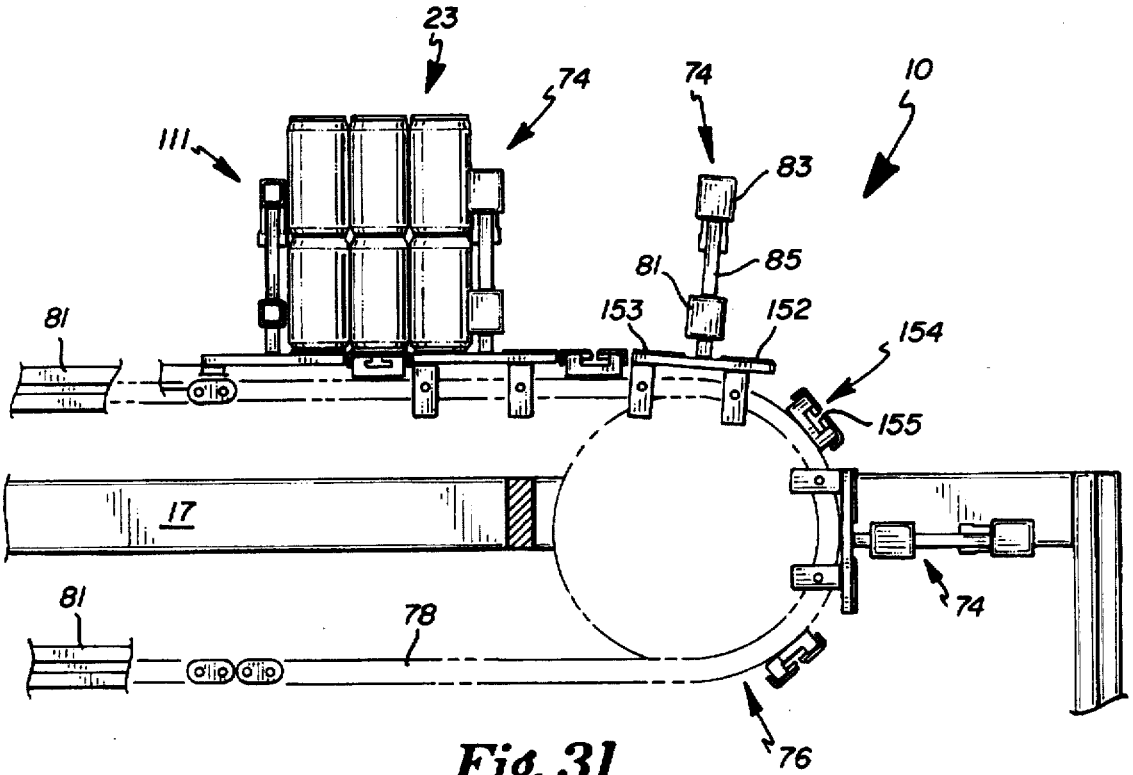
FIG. 31 is a detailed side view of the flight bar structures of the article group selection and transport mechanism.

Referring also to FIG. 31, the flight bar assemblies 74 are each shown to include a top rail member 83 and a bottom rail member 84 which are connected to one another by vertical spacers 85. The top and bottom members 83 and 84 are shown disposed parallel to one another and spacially separated by the spacers 85. Each top and bottom member 83 and 84 further has an angled front end 150 and an elongated, rectilinear body 151 terminating in a flat back end. The front end 150 slants or angles inwardly from its leading edge to its trailing edge to enable the flight bars 74 to select individual articles 20 disposed in the article infeed lanes and to separate them from the closely spaced nearest upstream article 20. As is best shown in FIG. 7, a pair of fixed slide plates 152 and 153 are connected to each flight bar 74 assembly. Both the flight bars 74 and the slide plates 152 and 153 are connected to the flight chains 78 via connection brackets 86. The slide plates 152 and 153 are thin, flat structures with a low friction top surface which support the lower article groups 21 and further permit sliding movement thereon. Additionally, slotted slide plates 154 are disposed between adjacent flight bar assemblies 74, each plate 154 including a laterally oriented slot 155.

The height of the flight bar 74 (i.e., the separation distance between the top and bottom members 83 and 84) is a function of the container and container group size and configuration. For example, taller cans (12 oz.) require greater flight bar 74 height than a short can (10 oz.), for proper selection and transport. The width of the top and bottom members 83 and 84 is a function of the desired dimensions of the product groups 21 and 22 formed. It is within the purview of this invention that the flight bar 74 height and width be fully adjustable to accommodate various container and group parameters.

Figure 8:
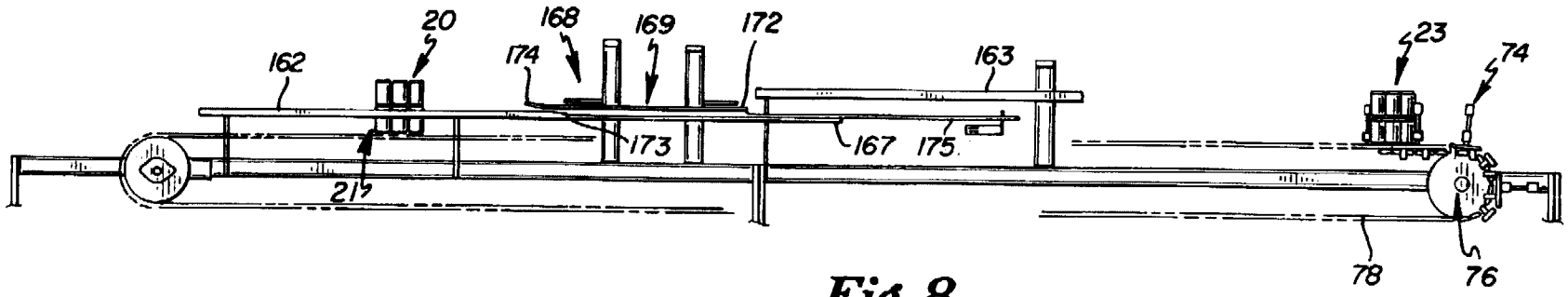
FIG. 8 is a side view of selected portions of the article group selection and transport mechanism.
Figure 9:
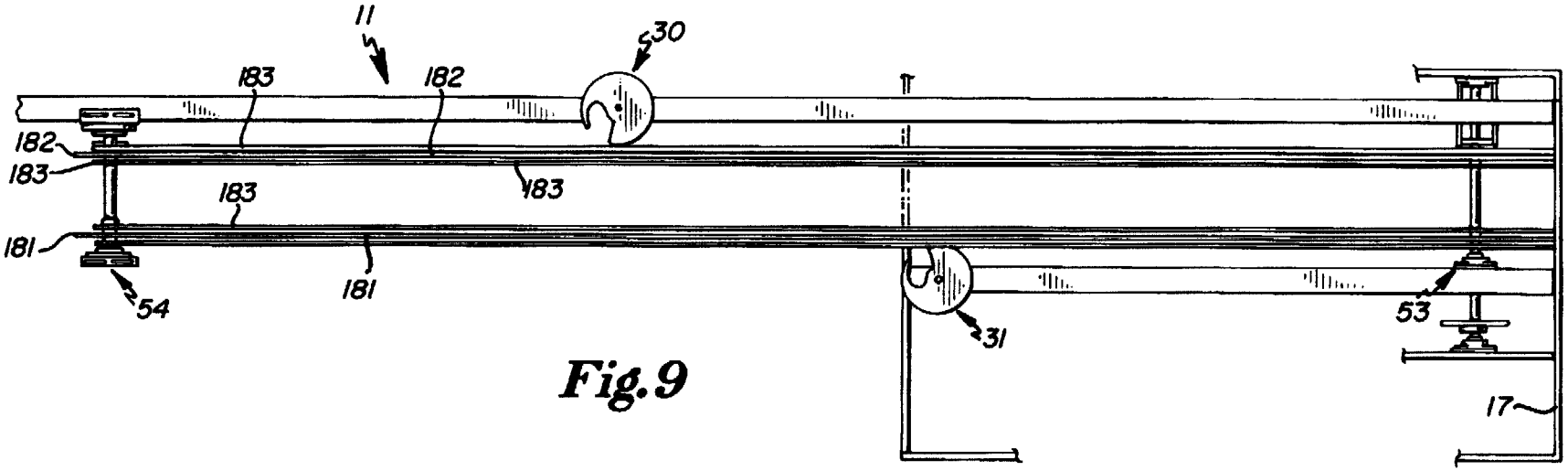
FIG. 9 is a top view of a portion of the carton supply and transport mechanism.
Figure 10:
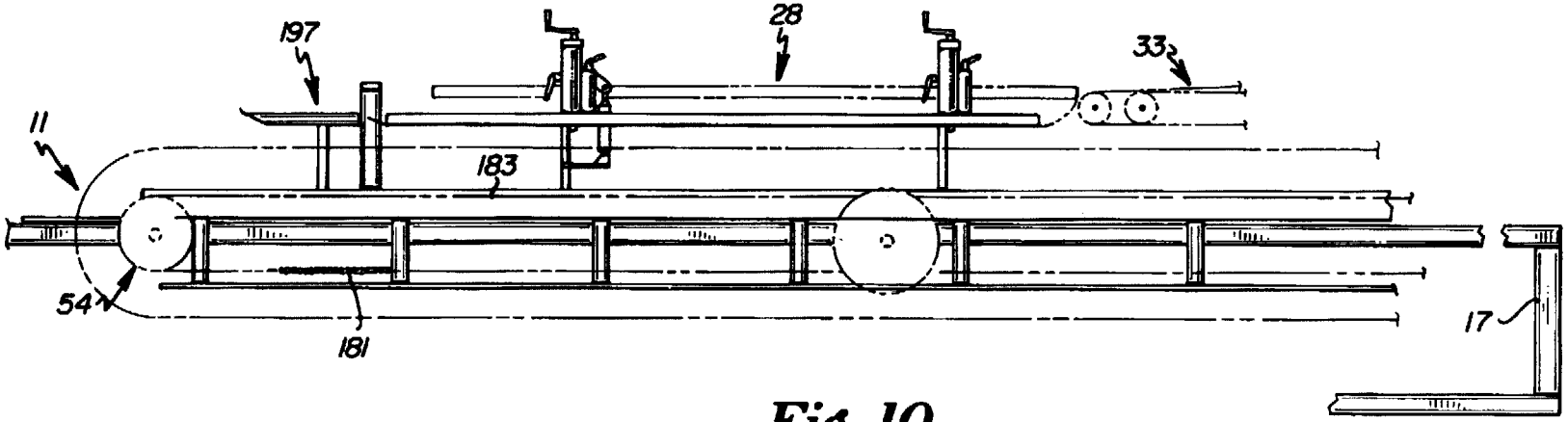
FIG. 10 is a side view of a portion of the carton supply and transport mechanism.

As is best shown in FIGS. 7, 8 and 21, a group stabilization structure 161 including a pair of longitudinally oriented upper and lower guide rails 162 and 163, and lateral adjustment structures 163 is disposed on the outer or lateral side of the article group selection and transport mechanism 12. The lower guide rail 162 extends from the upstream end of the mechanism 12 to a point anterior to a point on the mechanism 12 at which the upper group 22 is formed. The upper guide rail 162 extends throughout the region on the article group selection and transport mechanism 12 at which the upper group 22 is formed. The upper and lower rails 162 and 163 are disposed at predetermined vertical levels, between the upper and lower members 83 and 84 of the flight bars 74, to contact the base and upper article subgroups 21 and 22 respectively. The lateral extension distance of the rails 162 and 163 is adjustable by means of the lateral adjustment structures 164 for varying article group 23 sizes.

Figure 19:
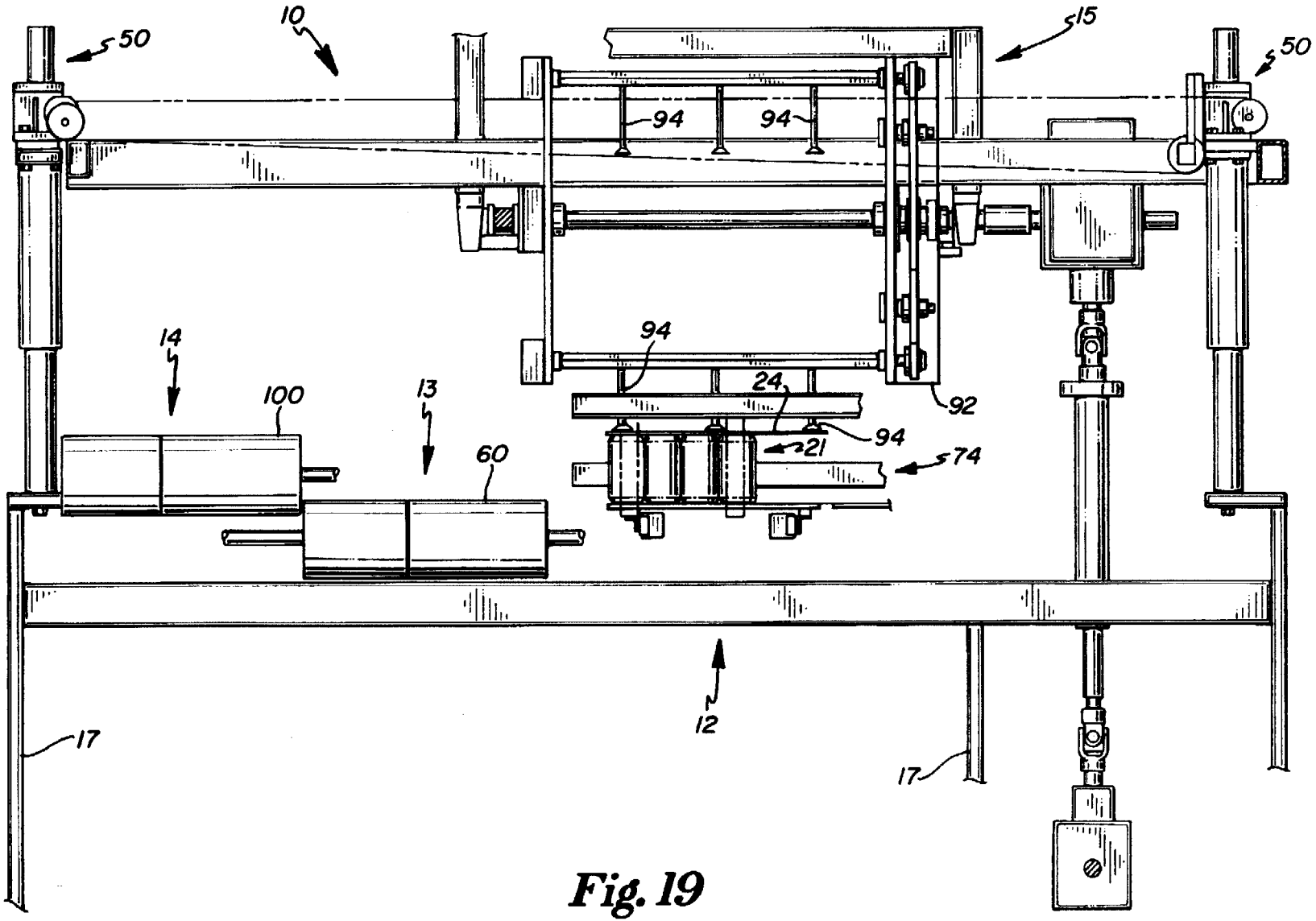
FIG. 19 is a crossectional view of the cartoner apparatus taken approximately along line 19—19 of FIG. 5.
Figure 20:
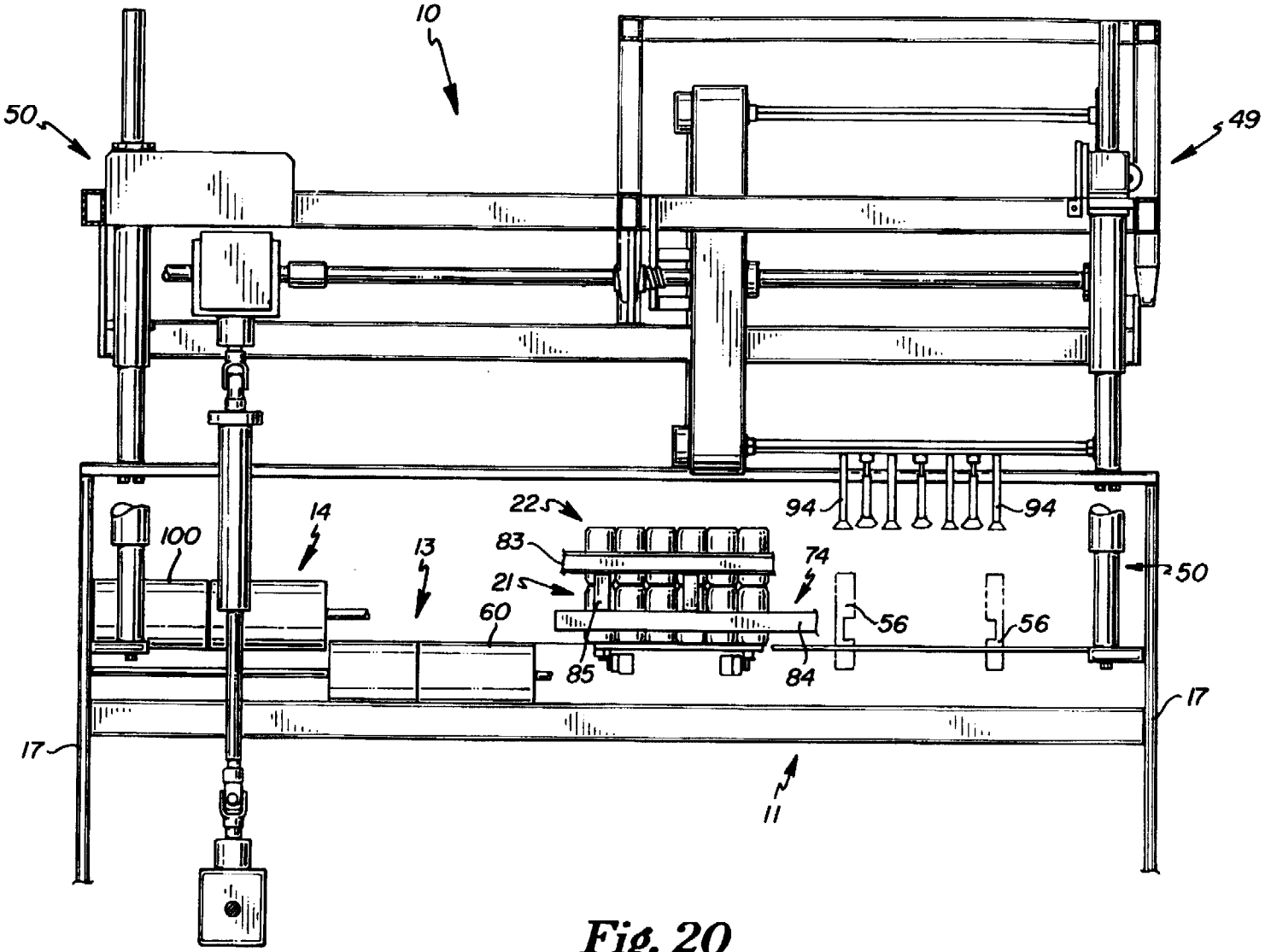
FIG. 20 is a crossectional view of the cartoner apparatus taken approximately along line 20—20 of FIG. 5.

Referring to FIGS. 5 and 19 the divider placement mechanism 15 deposits a divider sheet 24 on the top surface of lower or base article group 21 formed and traveling on the article group selection and transport mechanism 12. The divider placement mechanism 15 is shown to be disposed above the article group selection and transport mechanism 12 at a predetermined point downstream from where the base article group 21 is first fully formed. The divider placement mechanism 15 preferably comprises a rotary placer mechanism 92 of the type manufactured and sold by Applicant' assignee and having a pair of apex positions with vacuum control members 94. A power magazine 93 is shown operatively connected to the placer 92 to provide a continuous supply of divider sheets 24 thereto. Although a rotary-type placer is preferred for divider sheet placement, other placement means may be substituted to practice the basic method of this invention.

Referring again to FIGS. 7, 8 and 21, a divider hold down assembly 168 including a pair of medial and lateral rails 169 and 170 and adjustment structures 171 is disposed above a segment of the article group selection and transport mechanism 12, extending downstream from a point immediately posterior to the point of placement of the divider sheet 24 by the placer 92. The medial rail 169 has a anterior segment which includes a top member 169 with an upturned forward lip 174 and a side member 173 with a plow configuration, and a rail shaped posterior segment 175. This configuration is designed to engage and fold down the medial flap on the divider sheet 24, formed by a perforation or scoreline, and to hold the flap down over the medial edge of the lower article sub-group 21 to stabilize the position of the divider sheet 24 during downstream transport and lateral movement of the upper article sub-group 22 across the divider sheet 24 top surface. The lateral rail 170 extends a predetermined distance downstream to stabilize the lateral edge region of the divider sheet 24 prior to lateral merging of the upper group 22 across the divider sheet 24. The structure of the divider hold down assembly 168 has been shown to yield a substantially flat divider sheet 24 for improved article group 22 merging thereacross, especially in paperboard divider sheets 24 constructed with recycled materials which tend not to lay flat when unstabilized.

Referring again to FIGS. 5, 6 and 13, the second or high article supply mechanism 14 provides a plurality of input individual articles 20 to the apparatus 10 at a second predetermined level or height and at a predetermined point downstream from the low article supply mechanism 13. The mechanism 14 is also shown to comprise a pair of conveyors 100 and 101, each being disposed about a drive sprocket/shaft assembly and an idler sprocket/shaft assembly. The conveyors 100 and 101 may consist of a plurality of individual tracks or paths or alternatively a unitary, wider path or belt. Articles 20 transported on the top, forward run of the conveyors 100 and 101 are separated into a plurality of single file paths by lane separators 102. Each lane separator 102 is shown to be an upstanding wall of a height sufficient to guide the flow of one or more containers 20 on the conveyors 100 and 101, and which is suspended above the conveyors 100 and 101. The lane separators 102 form product conveyance lanes which angle towards the article group selection and conveyance mechanism 12 at an approach angle of approximately 20–25 degrees with respect to the longitudinal axis of the mechanism 12. The conveyors 100 and 101 are disposed parallel with the article group selection and transport conveyor 12. Conveyor 101 is further disposed immediately adjacent the article group selection and transport conveyor 12 to allow for article 20 movement thereinbetween. A dead plate region is also preferably utilized. Each lane separator 102 has a terminal portion 103 of a predetermined length, such that it extends into the path of the article group selection and transport mechanism 12 a predetermined distance. Each terminal portion 103 is constructed such that it allows the longitudinally transported flight structures 74 of the article group selection and transport mechanism 12 to pass through the angled conveyance lanes. As the flight structures 74 mesh with and pass through the lane separator end portions 103, they engage articles 20 disposed in lanes and rake them onto the longitudinal conveyance path of the mechanism 12.

The combination of forces exerted by the flight bars 74, lane ends 103, and conveyors 100, 101 and 73 serve to select and meter individual articles 20 into predetermined upper article groups 22 which are merged onto the divider sheet 24 on top of the lower or base article group 21 traveling on the article group selection and transport mechanism 12. The size, orientation and peripheral dimensions of the resultant upper product groups 22 is dependent upon the number of infeed lanes, product dimensions, and the configuration and spacing of the flight bars 74. The divider sheet 24 provides a low friction base surface upon which the upper group 22 is transversely, slidably moved to form a stacked group 23. Lanes may be blocked off by closure means 104 to alter the group 22 size and/or orientation. The lane separators 103 and the flight bars 74 are adjustable to provide full variability of product group parameters.

Figure 32:
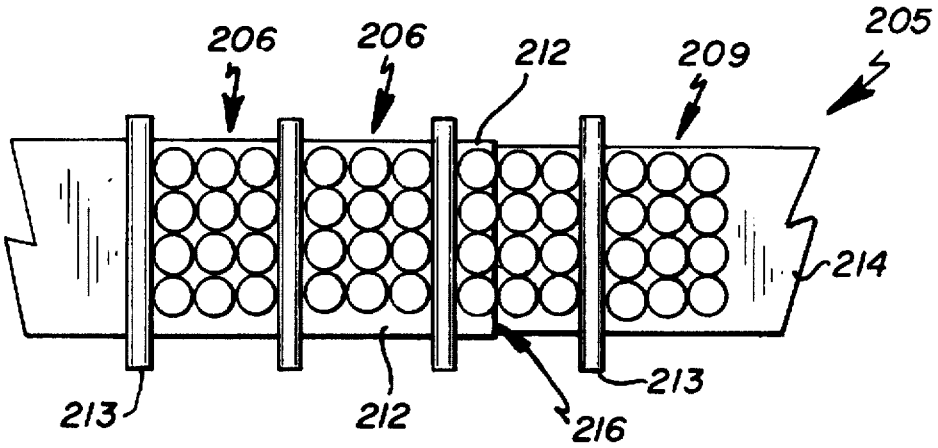
FIG. 32 is a top view of the loading zone of an alternative embodiment of the present invention.
Figure 33:
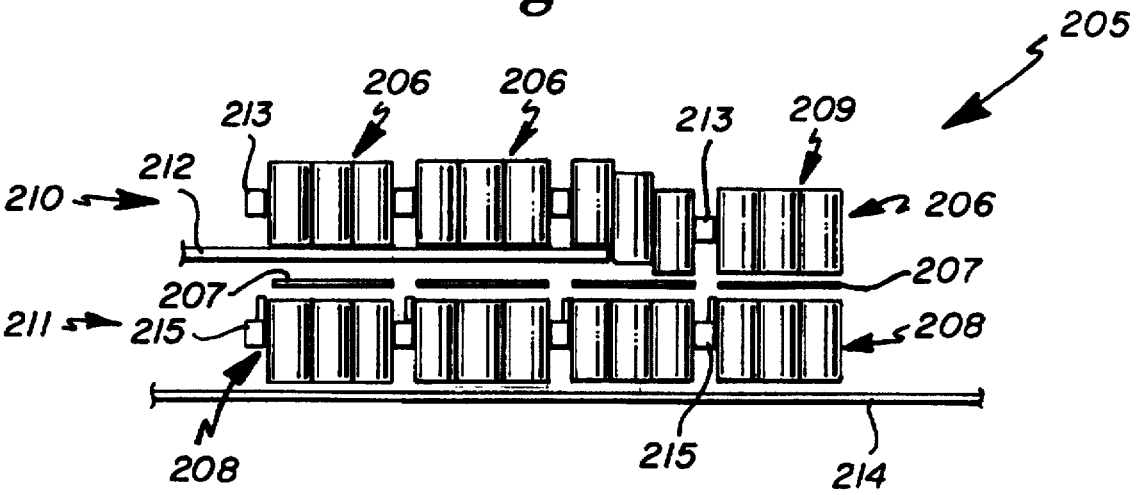
FIG. 33 is a side view of the embodiment shown in FIG. 32.

Referring to FIGS. 32 and 33, a portion of an alternative embodiment of the stacked article cartoning apparatus 205 is shown wherein upper article sub-groups 206 are deposited on the top surface of divider sheet 207 on lower article sub-group 200 to form a stacked article group 209. In this embodiment, an upper stream 210 of article sub-groups 206 is disposed above and in longitudinal alignment with a lower stream 211 of article sub-groups 208. The upper stream 210 is shown to include a dead plate 212 across which the upper article sub-groups 206 are moved by the action of upper pusher bars 213. The lower stream 211 includes a conveyor 214 and flight bars 215. As shown, the upper article sub-groups 206 are dropped directly, vertically on top of the divider sheet 207 as they move over the terminal edge 216 of the dead plate. Longitudinal movement of the upper and lower article sub-groups 206 and 208 is synchronized.

The article group lateral transfer or crossloading mechanism 16 is synchronized with the aforementioned apparatus 10 elements to move completed, stacked article groups 23 traveling on the article group selection and transport conveyor 12 into aligned cartons 25 traveling on the carton supply and transport conveyor 11. Referring to FIGS. 7, 18, 22 and 26–30, the crossloading mechanism 16 basically comprises a plurality of loader arm assemblies 110, a flight chain and guide tube assembly 111 to which the loader arm assemblies 110 are attached at predetermined intervals, and which provides a longitudinal movement component thereto, and a control cam assembly 112 which provides a predetermined transverse motion component to the loader arm assemblies 110.

The flight chain and guide tube assembly 110 has a forward or top run 113 and a return or bottom run 114 and comprises drive and idler sprocket/shaft assemblies 115 and 116 and a pair of spacially parallel flight chains 117 and 118 which are connected to and revolve about the sprocket/shaft assemblies 115 and 116. The flight chains 117 and 118 are maintained in a rectilinear configuration on both the top and bottom runs 113 and 114 by chain guides 119 and 120, which are linked to the frame 17 via vertical support members 121.

Figure 29:
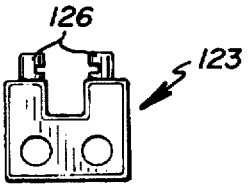
FIG. 29 is an end view of a loader arm guide.

Pairs of elongated guide tubes 122 are disposed at predetermined intervals along the flight chains 117 and 118, each guide tube 122 being directly connected at one end to the outer flight chain 118, and at its opposite end to the inner flight chain 117 so that they are oriented transversely with respect to the axis of the apparatus 10 and to the downstream or forward run of the crossloader 16. The guide tubes 122 have a low friction exterior surface to provide slidable support of the loader arm assemblies 110. The pairs of closely spaced tubes 122 increase the stability of transverse movement of the arm assemblies 110. Further stability is attained by the guide blocks 123 (connected to the inner ends of the guide tubes 122 via set screws) traveling in a longitudinally oriented guide rail 124 which is linked to the frame 17 via a support 125. As best shown in FIG. 29, lateral retainers 126 are mounted on the top of each guide block 123 to guide the transversely moving arm assemblies 110. The spacing between successive sets (pairs) of tubes 122 corresponds to the spacing between the flight bars 74 of the article group selection and transport conveyor 12 and of the flight lugs 56 of the carton transport conveyor 11 so that the arm assemblies 110 are aligned to push product groups 23 from between the flight bars 74 into the cartons 25.

The loader arm assemblies 110 are movably mounted on the guide tubes 122, and in a transverse orientation with respect to the axis of the apparatus 10. The arm assemblies 110 are conveyed in a downstream, longitudinal direction while they simultaneously reciprocate in a transverse direction under the control of a cam mechanism 112 described below. Each loader arm assembly 110 basically comprises an elongated, rectilinear base plate 127 and a loading head 128 located at one end of the base plate 127. The base plate 127 is shown to have a rigid, flat, elongated structure which is oriented horizontally. A rigid stiffing bar 129 is connected to the top surface of the base plate 127, vertically oriented, to increase the rigidity and strength of the arm assembly 110. Preferably, a plurality of bores are disposed in the stiffing bar 129 to reduce its weight. The inwardly disposed end of the base plate 127 is slidably supported by the lateral retainers 126 of the guide block 123. A first or outer bushing block 130 is connected to the bottom of the base plate 127 at its opposite end. The first bushing block 130 has a pair of apertures, including bushings, through which the guide tubes 122 are slidably extended. A second or inner bushing block 131 is similarly connected to the base plate 127 and interfaces with the guide tubes 122 a short distance from the first bushing block 130. The bushing blocks 130 and 131 are further connected by a spreader bar 132 which is oriented and rides in the space between the guide tubes 122. A rotatable cam follower 133 is connected to the bottom of the spreader bar 132. The longitudinally traveling cam follower 133 cooperates with the cam guide assembly 112 to cause the arm assembly 110 elements to transversely reciprocate on the guide tubes 122 and through the lateral retainers 126 of the guide block 123.

The loading head 128 is shown to have two fixed, flat face members 134 and 135. As the arm assemblies 110 move forward, the face members 134 and 135 push the article groups forward from the article group selection transport conveyor 12 into the cartons 25. A support roller 144 is disposed on the bottom of the head 128 to provide support when the head 128 is extended across the article group selection and transport mechanism 12. Additionally, a t-shaped guide pin 145 is disposed on the bottom of the base plate 127 of the arm assembly 110 to mate with the slot 155 in slide plate 154 to laterally stabilize the arm member 110 during high speed operation. The loading head 128 configuration is variable to interface with a wide range of product group 23 configurations. Although in the instant embodiment the head 128 is configured for use with a stacked configuration, the head 128 can be modified for cartoning various other product and product group arrangements, including non-stacked configurations. Head 128 modification is accomplished by changes in the configuration of the face members 134 and 135. A transition conveyor 29, shown in FIGS. 2 and 22, is disposed between the crossloading mechanism 16 and the carton transport mechanism 12 to provide a moving base for the movement of the article groups 23 into the longitudinally conveyed cartons 25. A fixed dead plate may alternatively be used. The bottom member 84 of the flight bars 74 is elongated to extend across the top run of the transition conveyor 29 to guide or funnel article groups 23 across the conveyor 29 and into the cartons 25, between the carton end panels 44.

The loader control cam assembly 112 controls the transverse, reciprocal motion of the arm assemblies 110. The loader control cam assembly 112 is generally oriented longitudinally with respect to the overall crossloading mechanism 16, and has a top or forward run 136 and a bottom or return run 137 corresponding to the revolving arm assemblies 110. The top run 136 basically comprises an inwardly sloping approach segment 137, an apex 138, and an outwardly sloping return segment 139. In the approach segment 137, the cam follower 133 is urged inwardly, and drives each arm assembly 110 into moving engagement with a product group 23 until it is loaded in a carton 25. A lag segment 146 of decreased slope is disposed at a predetermined point where the loading head 128 first contacts the article group 23 to provide gentle, even pressure at this initial contact point. In the return segment 139, the face 128 is retracted from the carton 25 prior to its being reset in the return run 137 of the cam assembly 112. The forward run 136 of the cam assembly 112 comprises an outer rail 140 and an inner rail 141 which is spaced from the inner rail 140 a distance equivalent to the diameter of the cam follower 133. The follower 133 is disposed in a cam pathway formed between the outer and inner rails 140 and 141 to effectuate transverse, inward motion to the arm assemblies 110. Preferably, the outer rail 140 is connected to a pivot point 142 at one end and to a release mechanism, such as a pressure release cylinder and piston 143 proximate its opposite end. The release mechanism 143 is controlled by a sensing mechanism, for example, a photoeye or capacitive proximity sensor, such that if an excessive force is placed on the outer rail 140, for example due to a jamming of the arm assembly 110, the release mechanism 143 will be actuated releasing the outer rail 140 which pivots about point 142.

The bottom or return run 136 of the cam assembly 112 includes circular guide plates 148 and 149, and a bottom cam rail 147 which contacts the cam follower 133 to further retract and reset the loader arms 110 for further loading cycles. Since the loader arms 110 are substantially extended when they revolve around sprocket/shaft assembly 115, it is critical that they be stabilized by the guide pin 145 in slide plate 154 groove 155 during high speed operation.

As shown in FIGS. 2, 6, 7, 9 and 23, lateral and medial flap tuckers 30 and 31 are disposed adjacent each side of the carton transport mechanism 11, one anterior to the loading region to provide a closed carton backside against which the loaded containers may nest, and one posterior to the loading region to allow article group 23 ingress to the carton 25 through its open, unglued end flaps 44.

Figure 12:
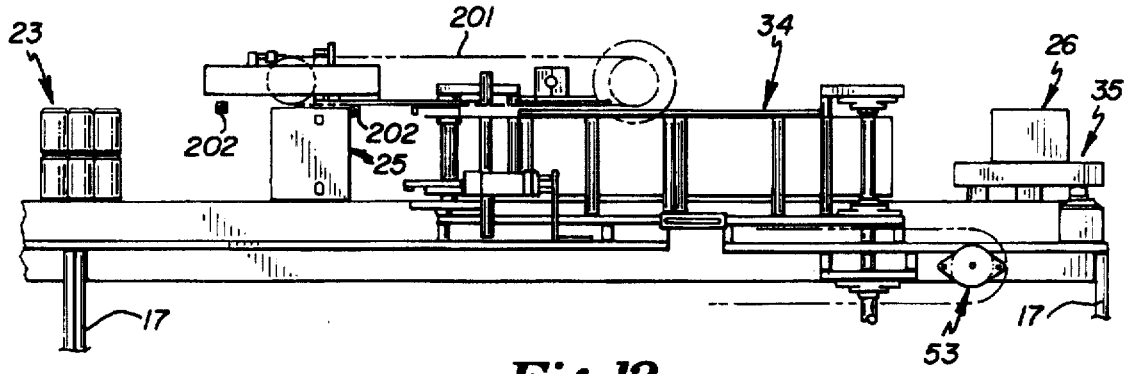
FIG. 12 is a side view of the discharge end of the carton supply and transport mechanism.

Referring to FIGS. 1 and 12, an overhead carton squaring station 33 is shown disposed immediately downstream of glue stations 37, immediately above the carton supply and transport mechanism 12, and extending a predetermining longitudinal distance downstream. The overhead station 33 assists in maintaining the squareness of the loaded cartons. The overhead compression station preferably comprises an endless chain 201 with a plurality of vertical lugs 202 having a bottom downstream run of a predetermined longitudinal distance and being disposed a predetermined vertical distance above the article transport conveyor 12. The vertically disposed lugs 202 have a predetermined configuration such that they aid in maintaining the squareness of the cartons 26. One or more compression belts (not shown) may additionally be added for package control purposes.

As shown in FIGS. 1, 6, 24 and 25, gluing, side compression and discharge mechanisms 32 and 37, 34 and 35 are disposed consecutively, further downstream and adjacent the carton supply and transport mechanism 11 to complete the carton flap securement process.

As many changes are possible to the embodiments of this invention utilizing the teachings thereof, the descriptions above, and the accompanying drawings should be interpreted in the illustrative and not the limited sense.

That which is claimed is:

1. A continuous method for forming stacked article groups, comprising the steps of:

a) supplying at least one stream of articles at a first predetermined location and a first vertical level along a longitudinally oriented axis;

b) forming and longitudinally transporting a stream of lower article sub-groups at said first location with an article group selection and transport mechanism having a plurality of fixed, transversely oriented, longitudinally moving flight bars which intersect said at least one stream of articles;

c) depositing a divider structure on each said lower article sub-group at a second predetermined location along said axis, downstream from said first location, said divider structure having a thin, substantially flat, rectilinear configuration with a surface area substantially coextensive with that of the top surface of said first article group, said divider structure further having a flap member disposed along a base edge and defined by a scoreline, said flap member being foldable over one edge of the top surface of said first article group;

d) supplying at least one stream of articles at a third location downstream from said second location, and at a second vertical level higher than said first vertical level;

e) forming, at said third location, an upper article subgroup on each said divider structure of each said lower article sub-group with said article group selection and transport mechanism, whereby stacked article groups are formed; and f) transporting said stacked article groups along said longitudinal axis.

2. A method for forming stacked article groups, comprising the steps of:

a) supplying at least two streams of articles, each at a predetermined vertically distinct level;

b) forming and longitudinally transporting a stream of first article sub-groups at a first level with an article group selection and transport mechanism having a plurality of fixed, transversely oriented, longitudinally moving flight bars which intersect said at least two supplied streams of articles;

c) placing a support base on a top surface of each said first article subgroup, said support base being substantially flat and having at least one flap member disposed along an edge thereof, said flap member being foldable over an edge of said top surface of said first article subgroup; and d) forming a second article subgroup at a second level on top of said support base of each said longitudinally moving first article subgroup, with said article group selection and transport mechanism, whereby stacked article groups are formed.

3. The method of claim 1 wherein two article streams are supplied, a first said article stream being supplied at a first longitudinal position, and a second article stream being supplied at a second, distinct longitudinal position, said first article sub-group being formed at said first position, said second article subgroup being formed at said second position, and said support base being placed at a position between said first and said second positions.

4. The method of claim 3 wherein said second article subgroup is slidingly moved across said support base while forming said stacked article group.

5. The method of claim 2, further comprising the step of placing said stacked article groups in cartons.

6. The method of claim 5, wherein said cartons are provided in a longitudinally oriented stream, synchronized with said stacked article groups, and further have open ends facing said stacked article groups.

7. The method of claim 6, wherein said stacked article groups are placed into cartons by laterally loading them into open sides of the cartons.

8. The method of claim 6, wherein said support base is constructed of paperboard.

9. The method of claim 4 further comprising the step of stabilizing said support base on its operative top position on said first article subgroup.

10. The method of claim 2, wherein said infeed articles are further segregated into at least two rectilinear article lanes.

11. The method of claim 10 wherein said article lanes intersect said longitudinal stream at a predetermined angle and wherein said first and second article subgroups are formed by being raked from said article lanes.

12. The method of claim 7, wherein the carton is constructed of paperboard and includes an outer structure with top, bottom, front and rear sides, and open ends bounded by end flaps, and wherein the articles are beverage cans.

13. A method of continuously loading cartons with stacked article groups having upper and lower sub-groups of articles, comprising the steps of:

a) supplying a first input stream of articles at a first location;

b) selecting articles at said first location with flight bars to form a lower article sub-group;

c) transporting the lower article sub-group longitudinally to a second location;

d) depositing a base structure on said lower article subgroup prior to its arrival at said second location;

e) supplying a second input stream of articles at said second location;

f) selecting articles, with said flight bars, at said second location to slidably form an upper article sub-group on top of the lower article subgroup across said base structure, to thereby form a stacked article group;

g) longitudinally transporting said stacked article group;

h) supplying and longitudinally transporting a carton in spacial synchronization with the stacked article group; and i) laterally transferring the stacked article group into the longitudinally transported carton.

14. A method for forming stacked article groups, comprising the steps of:

a) supplying at least two streams of articles, each at a predetermined vertically distinct level and predetermined longitudinally distinct positions;

b) forming and longitudinally transporting a stream of first article subgroups at a first level with an article group selection and transport mechanism having a plurality of fixed, transversely oriented moving flight bars which intersect said supplied at least two streams of articles;

c) placing a support base on a top surface of each said first article subgroup; and d) forming a second article subgroup at a second level with said article group selection and transport mechanism while slidingly moving articles over said support base of each said longitudinally moving first article group, whereby stacked article groups are formed.

* * * * *

UNITED STATES PATENT AND TRADEMARK OFFICE

CERTIFICATE OF CORRECTION

PATENT NO. : 5,692,361 
DATED : December 2, 1997
INVENTOR(S) : Kelly W. Ziegler, Jeffrey A. Lashyro and Gary J. Vulgamore It is certified that error appears in the above-identified patent and that said Letters Patent is hereby corrected as shown below:

Title page,
Item [75], Inventors, should read -- Kelly W. Ziegler --

Signed and Sealed this

Twenty-eighth Day of September, 2004

JON W. DUDAS
*Director of the United States Patent and Trademark Office*